US011192706B2

(12) United States Patent
Moriyasu et al.

(10) Patent No.: US 11,192,706 B2
(45) Date of Patent: Dec. 7, 2021

(54) WET SHEET PACKAGING BODY

(71) Applicant: TAIKI CORP., LTD., Osaka (JP)

(72) Inventors: Hayato Moriyasu, Osaka (JP); Toshiya Okuda, Osaka (JP)

(73) Assignee: TAIKI CORP., LTD., Osaka (JP)

( * ) Notice: Subject to any disclaimer, the term of this patent is extended or adjusted under 35 U.S.C. 154(b) by 4 days.

(21) Appl. No.: 16/344,606

(22) PCT Filed: Oct. 23, 2017

(86) PCT No.: PCT/JP2017/038215
§ 371 (c)(1),
(2) Date: Apr. 24, 2019

(87) PCT Pub. No.: WO2018/079496
PCT Pub. Date: May 3, 2018

(65) Prior Publication Data

US 2020/0062477 A1 Feb. 27, 2020

(30) Foreign Application Priority Data

Oct. 28, 2016 (JP) ..... JP2016-212222

(51) Int. Cl.
*B65D 77/06* (2006.01)
*A47K 7/00* (2006.01)
*B65D 83/08* (2006.01)

(52) U.S. Cl.
CPC ..... *B65D 77/062* (2013.01); *A47K 7/00* (2013.01); *B65D 83/0805* (2013.01)

(58) Field of Classification Search
CPC ..... A47K 7/00; A47K 10/421; B65D 77/062; B65D 83/0805
See application file for complete search history.

(56) References Cited

U.S. PATENT DOCUMENTS 2,158,712 A * 5/1939 West ..... B65D 83/08 221/49
3,207,361 A * 9/1965 Marcalus ..... A47K 10/421 221/48

(Continued)

FOREIGN PATENT DOCUMENTS

EP 1717162 A1 11/2006
EP 2243410 A1 10/2010

(Continued)

OTHER PUBLICATIONS

International Search Report dated Dec. 19, 2017, issued in counterpart application No. PCT/JP2017/038215 (1 page).

*Primary Examiner* — Gene O Crawford
*Assistant Examiner* — Kelvin L Randall, Jr.
(74) *Attorney, Agent, or Firm* — Westerman, Hattori, Daniels & Adrian, LLP

(57) ABSTRACT

The wet sheet packaging body includes a plurality of wet sheets (1), a packaging container configured to house the wet sheets. The packaging container includes a top surface and a dispensing opening, on the top surface, configured to take out each of the wet sheets, an opening and closing lid (5) configured to open and close the dispensing opening (33) of the packaging container, and the wet sheets housed in a layered state in the packaging container. The inner bag (2) includes an opening part (24) and a bottom part (21). The wet sheets are housed in the inner bag. The inner bag is housed in the packaging container while the opening part is directed downward and the bottom part is directed upward. The inner bag is pulled out from the dispensing opening of the packaging container for removal when use of the wet sheet packaging body is started.

12 Claims, 19 Drawing Sheets

(56) References Cited

U.S. PATENT DOCUMENTS 4,262,816 A * 4/1981 Margulies ..... A47K 10/3818 206/409
4,269,315 A * 5/1981 Boyce ..... B65D 77/02 206/438
4,535,912 A 8/1985 Bonk
4,877,154 A * 10/1989 Matsui ..... A47K 10/424 221/48
5,642,810 A * 7/1997 Warner ..... B65D 43/162 206/389
7,624,874 B2 * 12/2009 Douglas ..... B65F 1/06 206/581
7,695,037 B2 * 4/2010 Rhodes ..... B42D 5/00 294/137
2008/0099596 A1 5/2008 DeMaso et al.
2008/0164179 A1 * 7/2008 Douglas ..... B65F 1/06 206/570
2009/0223993 A1 * 9/2009 Lorenzati ..... A47K 10/46 221/35
2010/0243504 A1 * 9/2010 Long ..... B65D 83/0894 206/494
2010/0288666 A1 * 11/2010 Kobayashi ..... B65D 75/5827 206/449
2011/0162325 A1 * 7/2011 Stollery ..... B65B 25/20 53/447
2014/0116913 A1 * 5/2014 Thorburn ..... B65D 83/0805 206/494
2014/0217113 A1 * 8/2014 Gallagher ..... A45C 13/02 221/64
2016/0060019 A1 3/2016 Ishihara

FOREIGN PATENT DOCUMENTS

EP 2351696 A1 8/2011
JP 64-9181 U 1/1989
JP 2009-165763 A 7/2009
JP 2010-116200 A 5/2010
JP 2016-41593 A 3/2016
KR 10-2013-0066435 A 6/2013
KR 20130066435 A * 6/2013
WO 2014/129394 A1 8/2014

* cited by examiner

WET SHEET PACKAGING BODY

TECHNICAL FIELD

The present invention relates to a wet sheet packaging body in which a wet sheet is packaged.

BACKGROUND ART

A wet sheet is a sheet obtained by impregnating a sheet-like base material with a liquid such as a chemical. Examples of the wet sheet include a face mask impregnated with a liquid cosmetic material, a wet tissue, and a wet sheet for cleaning. The wet sheet is used for various types of applications. There is a case where a plurality of wet sheets are packaged individually by one sheet by one sheet. Further, there is a case where a plurality of wet sheets are collectively packaged while being layered vertically.

The present applicant has already proposed a wet sheet packaging body in which a plurality of wet sheets are collectively packaged, as in Patent Literatures 1 and 2 below. The wet sheet packaging bodies described in the following Patent Literatures 1 and 2 are manufactured according to the following procedure. In a relatively deep first tray container, a plurality of wet sheets are placed in a layered state. A relatively shallow second tray container is placed over the plurality of wet sheets. The tops and the bottoms of the first tray container, the plurality of wet sheets, and the second tray container are inversed. The tops and the bottoms of the first tray container, the plurality of wet sheets, and the second tray container, which are inverted, are housed into a packaging box or a pillow packaging bag. The first tray container has a posture where a bottom part is directed upward. On the bottom part of the first tray container, a hole is formed. The hole on the bottom part of the first tray container is sealed with a film from inside. On a top surface of the packaging box or the pillow packaging bag, a dispensing opening is provided. The dispensing opening is affixed, in a peelable and re-affixable manner, with a flap made of a flexible film. When in use, the flap is peeled to open the dispensing opening. Next, the film is taken from the dispensing opening for removal. Thereafter, the wet sheet placed on the top is taken out one sheet by one sheet in a sequential manner for use.

Inside the packaging box or the pillow packaging bag, the wet sheet packaging body includes the first tray container having shape retainability. Thus, when the wet sheet is taken out sequentially, the packaging box or the pillow packaging bag is hardly deformed. In particular, even when remaining wet sheets are small, a shape of the packaging box or the pillow packaging bag is retained. Even when the remaining amount is small, the wet sheet can be easily taken out. The wet sheet packaging body includes a double packaging form with the inside tray containers and the outside packaging box or pillow packaging bag. The wet sheet packaging body is of double packaging form, and thus, it is difficult to reduce costs.

Therefore, to achieve the cost reduction, the present applicant considered a configuration for achieving a simple packaging form. Specifically, a configuration as illustrated in FIG. 19(*a*) was considered. In the wet sheet packaging body, a plurality of wet sheets 1 are housed in a case 3 having a bottom surface opening part and the bottom surface opening part is hermetically closed by a bottom lid 4 formed of a film. On the top surface of the case 3, a dispensing opening 33 is formed. When in use, a flap 5 can be opened to sequentially take out a wet sheet 1 from the dispensing opening 33. With this configuration, a packaging container can be simplified so that the costs can be reduced. However, as illustrated in FIG. 19(*b*), upon manufacture, the dispensing opening 33 of the case 3 is directed downward. Thus, a liquid impregnated into the wet sheet 1 may be leaked out from the dispensing opening 33 during the manufacture. Further, an adhesive power of the flap 5 covering the dispensing opening 33 may gradually deteriorate due to the liquid. After the manufacture, the flap 5 may be opened automatically and a gap may be generated between the case 3 and the flap 5.

CITATION LIST

Patent Literature

[PTL 1] WO2014/129394
[PTL 2] Japanese Unexamined Patent Application Publication No. 2016-41593

SUMMARY OF INVENTION

Technical Problem

An object of the present invention is to provide a low-cost wet sheet packaging body designed to not easily generate a liquid leakage.

Solution to Problem

A wet sheet packaging body of the present invention is a packaging container including: a plurality of wet sheets; a packaging container configured to house the plurality of wet sheets, where the packaging container includes a top surface and a dispensing opening, on the top surface, configured to take out each of the wet sheets; and an opening and closing lid configured to open and close the dispensing opening of the packaging container, the plurality of wet sheets being housed in a layered state in the packaging container, wherein an inner bag including an opening part and a bottom part is provided, the plurality of wet sheets are housed in the inner bag, the inner bag is housed in the packaging container while the opening part is directed downward and the bottom part is directed upward, and the inner bag is pulled out from the dispensing opening of the packaging container for removal when use of the wet sheet packaging body is started.

The plurality of wet sheets may be directly housed in the packaging container. The plurality of wet sheets are housed in the packaging container while being housed in the inner bag. The inner bag is housed in the packaging container while the bottom part is directed upward and the opening part is directed downward. The bottom part of the inner bag faces the dispensing opening of the packaging container. The opening part of the inner bag faces an opening side of the dispensing opening of the packaging container. Thus, a liquid impregnated into the wet sheet cannot easily reach the dispensing opening.

In particular, it is preferable that the packaging container includes a case, and a bottom lid, the case includes a bottom surface opening part, and the bottom lid closes the bottom surface opening part of the case. The case having the bottom surface opening is used as the packaging container, and thus, the wet sheet packaging body has excellent shape retainability. When the wet sheet is taken out, a shape of the wet sheet packaging body is not easily deformed. Thus, the wet sheet can be easily taken out. In particular, even when remaining wet sheets are small, the shape of the wet sheet packaging body is retained. Thus, the wet sheet can be easily taken out and it is possible to maintain a good appearance. When the top and the bottom of the case is inverted during the manufacture, the inner bag and the wet sheet can be placed easily from the bottom surface opening part of the case.

In particular, it is preferable that the case includes a side surface part, the side surface part of the case includes a lower end surface, the bottom lid is configured of a film, and the bottom lid is heat sealed to the lower end surface of the side surface part of the case. With this preferable configuration, the wet sheet packaging body can be manufactured at a low cost.

Further, it is preferable that the case includes, at an opening edge of the dispensing opening, an annular projection protruding downward. When the inner bag is taken out from the dispensing opening, the inner bag will not easily adhere to inner surfaces of the case. Thus, the inner bag can be taken out smoothly from the dispensing opening. Further, when the wet sheet is taken out from the dispensing opening after the inner bag is taken out from the case, the wet sheet can be taken out smoothly. The annular projection supports the inner bag when the top and the bottom of the case is inverted during the manufacture, and thus, the inner bag is separated from the inner surfaces of the case. Thus, adherence between the inner surfaces of the case and the inner bag can be prevented.

Further, it is preferable that the inner bag is a lateral gusset bag. The inner bag includes a pair of left and right side gusset parts. Thus, the wet sheet can be easily housed in the inner bag while a plurality of wet sheets are layered, and can be easily taken out.

Further, it is preferable that the inner bag includes inner surfaces, the inner bag includes, at the bottom part, a protrusion piece with the inner surfaces of the inner bag overlapping with each other, and the inner bag can be pulled out from the dispensing opening of the packaging container by pinching the protrusion piece when use of the wet sheet packaging body is started. Upon starting the use, the inner bag can be easily taken out for removal from the dispensing opening of the packaging container.

Further, it is preferable that the inner bag includes an end at a side of the opening part, and the end at the side of the opening part of the inner bag is folded toward the bottom side of the wet sheet. When the end at the side of the opening part of the inner bag is folded inward, the layering of the plurality of wet sheets is retained by the inner bag. The wet sheet is not easily shifted in position in a lateral direction nor deformed. As a result, the wet sheet can be smoothly taken out. Further, the end of the inner bag is folded, and thus, passing of the liquid between the packaging container and the inner bag can be further prevented. It is further possible to prevent the liquid from reaching the dispensing opening. The wet sheet is impregnated with a liquid. Thus, the end of the inner bag folded toward the bottom side of the wet sheet strongly adheres, due to the liquid, to the wet sheet. The folded end of the inner bag is pressed against the packaging container by the weight of the plurality of wet sheets themselves located above the end. The folded end of the inner bag is sandwiched vertically between the wet sheet and the packaging container. Thus, a folded state of the end of the inner bag will be maintained. For example, even with vibration or the like in transit, the folded state of the end of the inner bag is maintained. Therefore, deformation and liquid leakage of the wet sheet in transit or the like can be surely prevented.

In particular, it is preferable that a center part of a bottom portion of the wet sheet is not covered with the inner bag and is exposed. The inner bag can be taken out easily from the dispensing opening.

Advantageous Effects of Invention

Thus, the wet sheet is housed in the inner bag with its bottom part directed upward, and therefore, the inner bag can effectively prevent generation of the liquid leakage before the wet sheet packaging body is opened. Cost reduction is also possible. The inner bag is removed from the dispensing opening when the use of the inner bag is started, and thus, upon taking out the wet sheet, the inner bag does not interfere.

DESCRIPTION OF EMBODIMENTS

Figure 1:
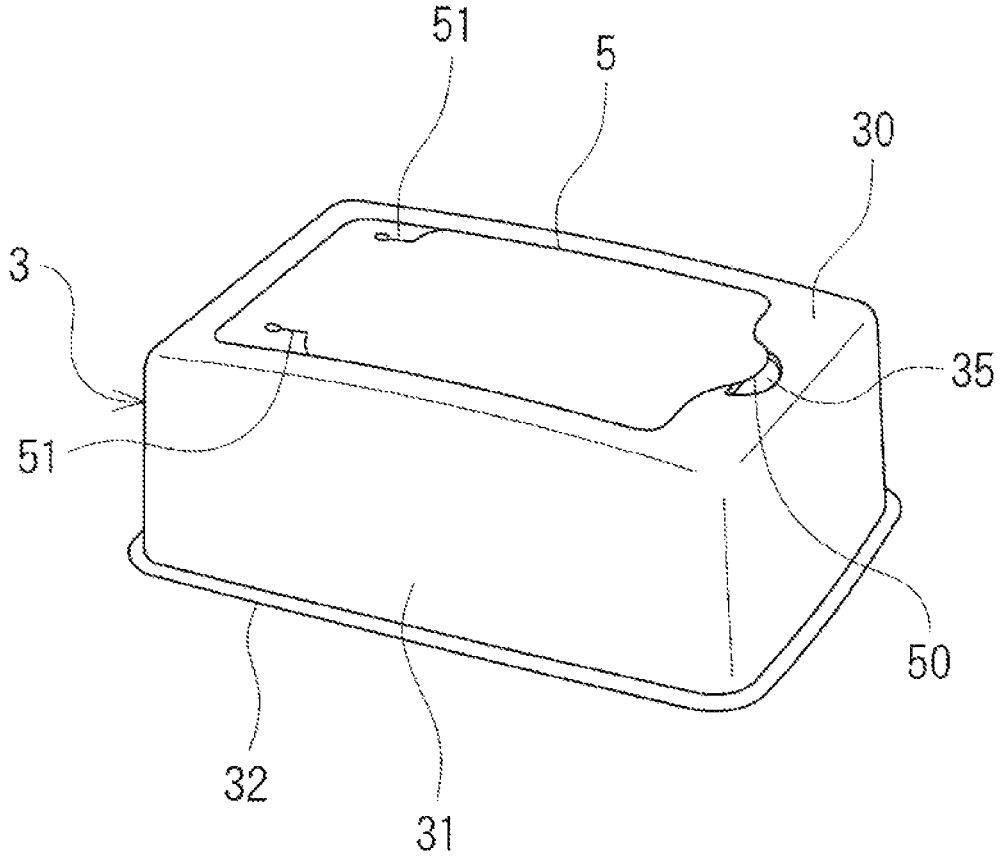
FIG. 1 is a perspective view of a wet sheet packaging body in one embodiment of the present invention.
Figure 2:
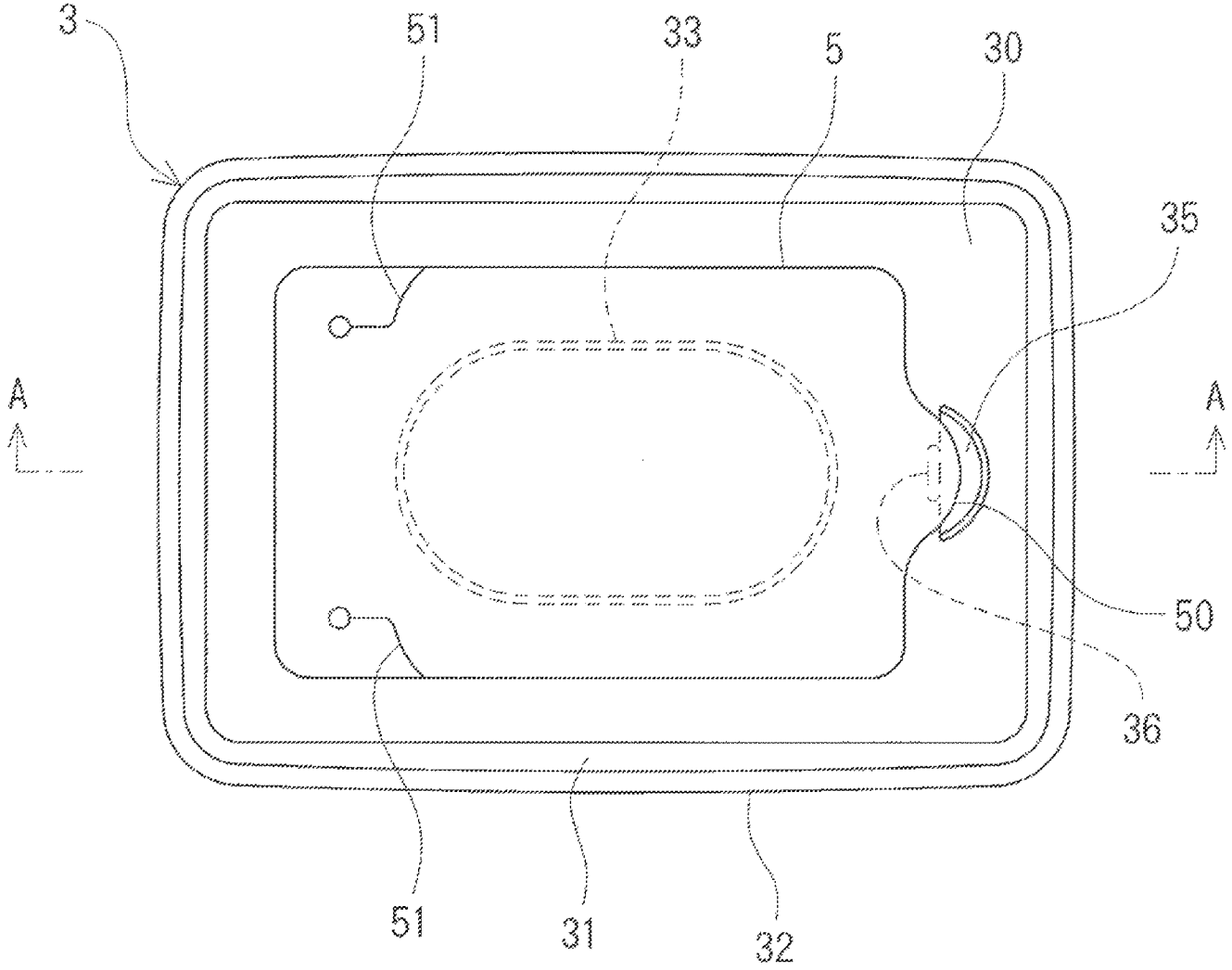
FIG. 2 is a plane view of the packaging body.
Figure 3:
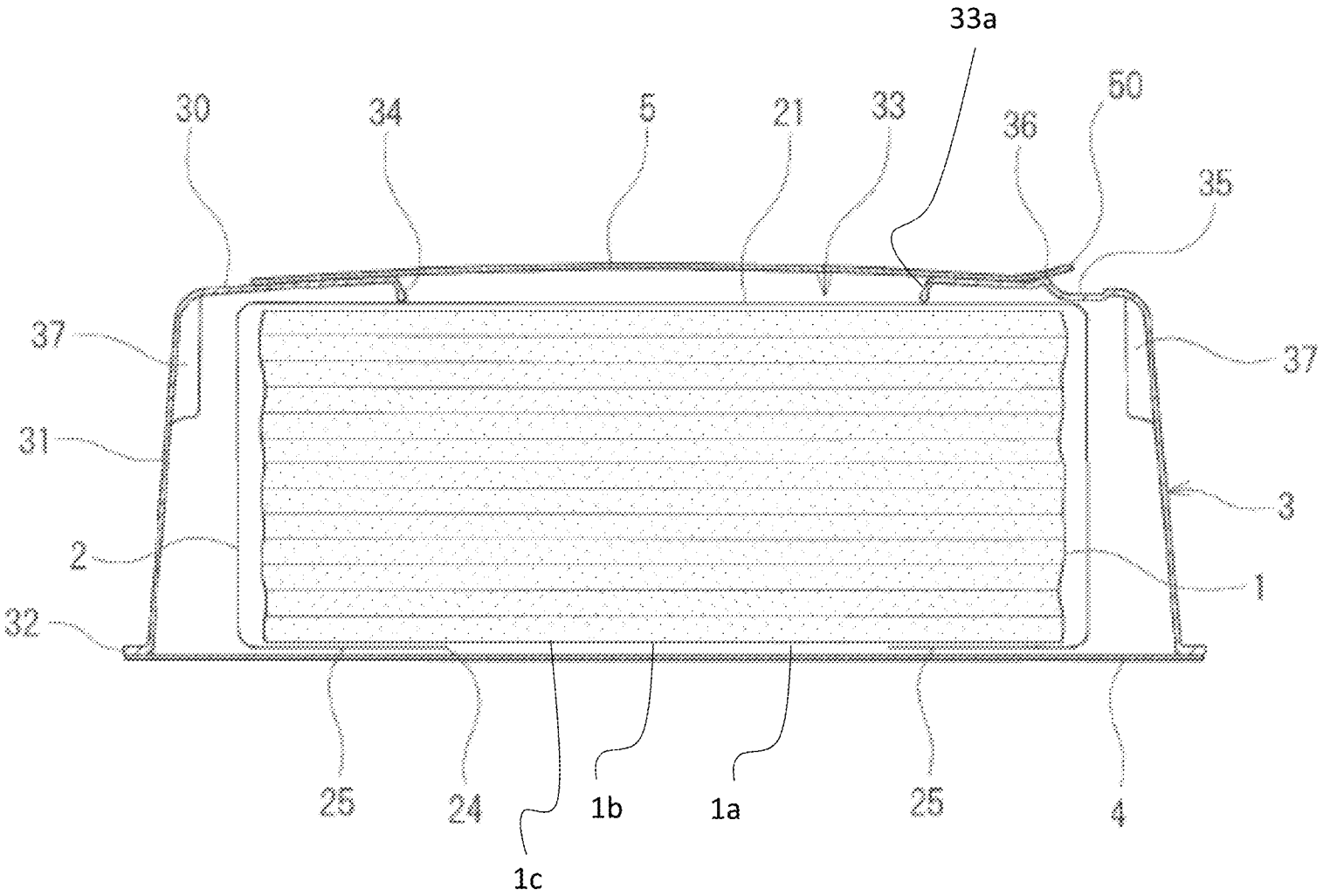
FIG. 3 is an end surface view taken along A-A of FIG. 2.

Below, a wet sheet packaging body according to an embodiment of the present invention will be described with reference to FIG. 1 to FIG. 15. Hereinafter, the wet sheet packaging body is simply referred to as "packaging body". The packaging body illustrated in FIG. 1 to FIG. 3 is obtained by collectively packaging a plurality of wet sheets 1 into a packaging container. The plurality of wet sheets 1 are collectively housed in an inner bag 2. The plurality of wet sheets 1 are housed in the packaging container while being housed in the inner bag 2. The packaging container includes a case 3 with its bottom surface being opened, and a bottom lid 4 configured to close a bottom surface opening part 38 of the case 3. On a top surface of the case 3, a dispensing opening 33 configured to take out the wet sheets 1 is formed. The top surface of the case 3 is affixed with a flap 5 as an opening and closing lid configured to freely open and close the dispensing opening 33. A detailed description will be given, below.

<Wet Sheet 1>

The wet sheet 1 includes various types of wet sheet including a face mask and a wet tissue. In particular, the wet sheet 1 is preferably a face mask. When the wet sheet 1 is a face mask, it is particularly preferable that the face mask is packaged to be folded one mask by one mask. The wet sheet 1 may be folded in various ways. The wet sheet 1 may be folded in half, in three, and in four, for example. The wet sheet 1 may be folded in a longitudinal direction only or in a lateral direction only. The wet sheet 1 may be folded respectively in both the longitudinal direction and the lateral direction. In particular, when the wet sheet 1 is a face mask, if the face mask can be folded in two direction, that is, in the longitudinal direction and in the lateral direction, the wet sheet 1 can be housed in a compact manner and the packaging body can be reduced in size. When the wet sheet 1 is a face mask, the face mask may be folded in a Z shape. When the wet sheet 1 is folded in the Z shape, an end of the wet sheet 1 can be held and picked up, as a result of which the wet sheet 1 is easily taken out in an entirely expanded state.

The wet sheet 1 is obtained by impregnating a sheet base material 10 with a liquid 11. The sheet base material 10 is a fiber sheet, for example. Typically, the sheet base material 10 is a nonwoven fabric. The nonwoven fabric having various types of materials can be used. The nonwoven fabric is made of at least one fiber selected from the group consisting of, for example, polyolefin fibers, cellulose fibers, nylon fibers, polyester fibers, acrylic fibers, polyacrylic acid fibers, polylactic acid fibers, and polyurethane fibers. A nonwoven fabric having a weight basis (grammage) of 20 to 200 g/m$^2$ may be employed. In a case of a face mask, the liquid 11 is a liquid cosmetic material. The cosmetic material is a liquid cosmetic material such as a beauty lotion, a lotion, a cosmetic liquid, and a milky lotion. The cosmetic material may be water-based and oil-based. The cosmetic material is effective in a skin care, in particular, in a face skin care.

<Inner Bag 2>

Figure 6A:
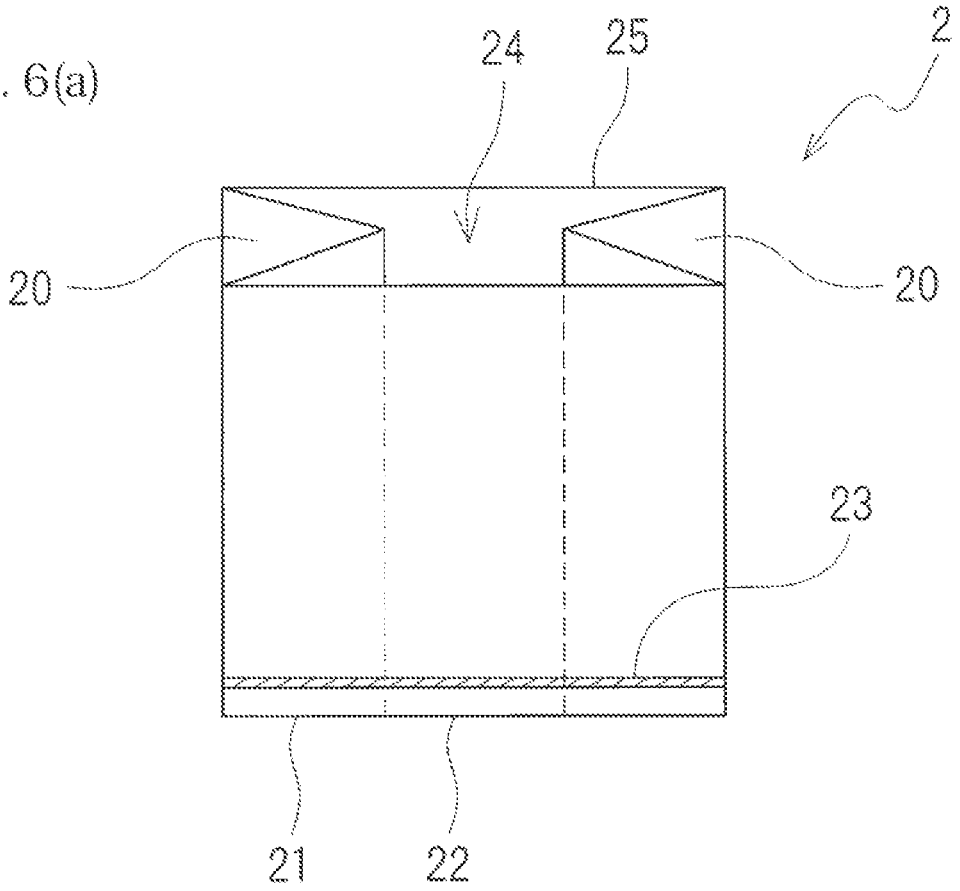
FIGS. 6(*a*) and 6(*b*) are perspective views each illustrating an inner bag used for the packaging body where FIG. 6(*a*) illustrates is a flat state and FIG. 6(*b*) illustrates an expanded state.
Figure 6B:
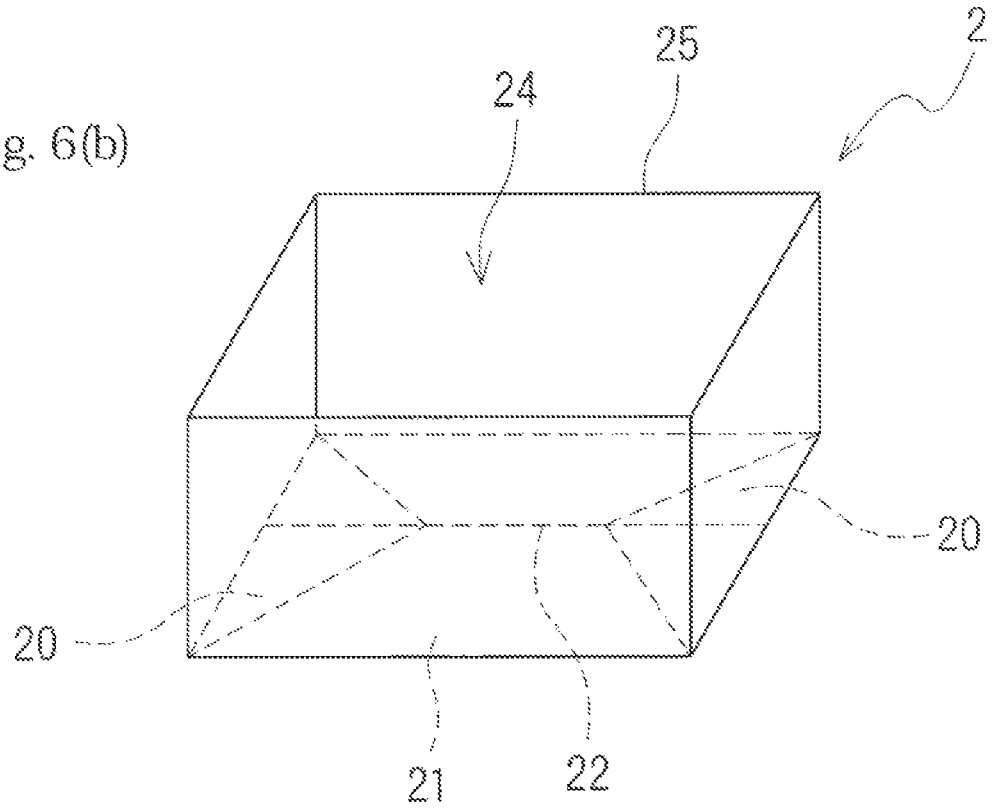

The inner bag 2 may include various types of bag forms such as a flat bag. In the present embodiment, the inner bag 2 is a lateral gusset bag. The lateral gusset bag includes a pair of left and right side gusset parts 20, as illustrated in FIG. 6(*a*). A bottom part 21 of the inner bag 2 is heat sealed and closed. A top of the inner bag 2 is opened. In the bottom part 21 of the inner bag 2, a protrusion piece 22 is formed over an entire width. The protrusion piece 22 is obtained by inner surfaces of a film configuring the inner bag 2 being overlapped and heat sealed. The protrusion piece 22 has a protrusion length that can be pinched by a finger tip. Preferably, the protrusion length of the protrusion piece 22 is 5 to 15 mm. A heat sealed bottom sealed part 23 is linear. The bottom sealed part 23 is formed over an entire width of the inner bag 2. The bottom sealed part 23 is located at a base end of the protrusion piece 22. A distal portion from the bottom sealed part 23 in the protrusion piece 22 is a portion where the films configuring the inner bag 2 are overlapped, but is not a heat sealed portion. As illustrated in FIG. 6(*b*), the inner bag 2 in an expanded state is in a rectangular shape in plan view as viewed from a side of the opening part 24. To be exact, the inner bag 2 in an expanded state is in an oblong shape. The protrusion piece 22 of the bottom part 21 runs along a long side direction of the oblong shape.

The inner bag 2 is configured of various types of films. In present embodiment, the inner bag 2 is in a seamless tubular shape with no seams. Thus, the inner bag 2 is configured of one tubular film. For example, when a long tubular film having a pair of side gusset parts 20 is cut by a predetermined length and heat sealed at the same time, the inner bag 2 with its upper end opened and its lower end closed can be formed, as illustrated in FIG. 6(*a*). It is noted that the inner bag 2 may be configured of two films. The inner bag 2 may be configured of a total of four films, that is, front and rear films (two films) and other two films configuring the side gusset parts 20.

The films configuring the inner bag 2 may be various types of synthetic resin films. It is particularly preferable that the films configuring the inner bag 2 are a polyethylene film (PE). When the inner bag 2 is made of the polyethylene film, the inner bag 2 has excellent flexibility with no particular strong rigidity. The inner bag 2 made of the polyethylene film can be easily taken out. The inner bag 2 made of the polyethylene film has excellent chemical resistance.

The inner bag 2 is housed in the case 3 while the top and the bottom of the inner bag 2 is inverted. The inner bag 2 is housed in the case 3 while the bottom part 21 is directed upward and the opening part 24 is directed downward. The protrusion piece 22 of the bottom part 21 faces the dispensing opening 33 of the case 3, as described later. The protrusion piece 22 of the bottom part 21 runs along a longitudinal direction of the dispensing opening 33. The protrusion piece 22 of the bottom part 21 runs along a long side direction of a ceiling part 30 of the case 3. The protrusion piece 22 is inclined toward a first surface, out of both front and rear surfaces of the protrusion piece 22.

An end 25 at a side of the opening part 24 of the inner bag 2 is folded inwardly, as illustrated in FIG. 3. The end 25 at the side of the opening part 24 of the inner bag 2 is located beneath a lowermost wet sheet 1. The end at the side of the opening part of the inner bag is folded toward the bottom side 1*a* of the wet sheet 1. FIG. 3 illustrates a state where there is a gap between the end 25 at the side of the opening part 24 of the inner bag 2 and the bottom lid 4. A reason for this is to facilitate understanding of a folded state of the end 25 at the side of the opening part 24 of the inner bag 2. In reality, the end 25 at the side of the opening part 24 of the inner bag 2 abuts against the bottom lid 4. A weight of the plurality of wet sheets 1 themselves acts on the end 25 at the side of the opening part 24 of the inner bag 2. The end 25 at the side of the opening part 24 of the inner bag 2 is pressed against the bottom lid 4. It is noted that a method of folding the end 25 at the side of the opening part 24 of the inner bag 2 will be described later.

<Case 3>

Various types of shapes of the case 3 may include a cylindrical shape which is in a circular shape in plan view. In the present embodiment, the case 3 is in a rectangular shape in plan view. Specifically, the case 3 is a laterally long oblong-shaped box form in plan view. The case 3 is in a shape where its bottom surface is opened. The case 3 includes the laterally long oblong-shaped ceiling part 30 and a side surface part 31 drooping from an edge of the ceiling part 30. At a lower end of the side surface part 31, a flange part 32 extends horizontally and outwardly. The flange part 32 is formed over an entire circumference. It is noted that the top surface of the ceiling part 30 is the top surface of the case 3. The top surface of the ceiling part 30 is an outer surface of the case 3.

Figure 5:
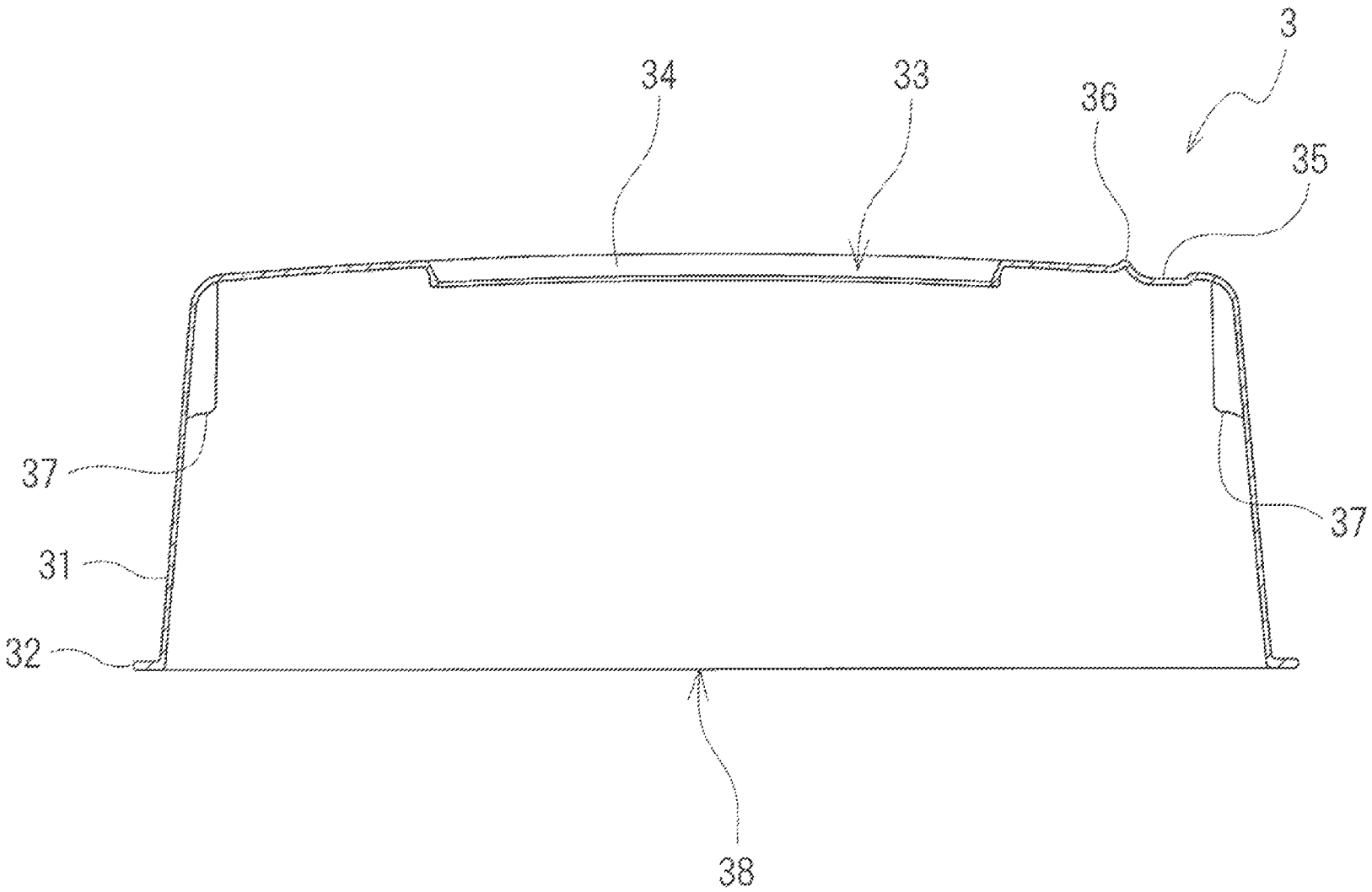
FIG. 5 is a cross-sectional view taken along B-B of FIG. 4.

The ceiling part 30 is not a flat surface, as illustrated in FIG. 5. The ceiling part 30 is shaped to be slightly curved upward along the long side direction. A shape of the ceiling part 30 along the short side direction is not curved but takes a line shape. The shape of the ceiling part 30 along the short side direction is horizontal. It is noted that in the following description, the long side direction of the ceiling part 30 is sometimes referred to as "left-right direction". Further, the short side direction of the ceiling part 30 is sometimes referred to as "front-rear direction".

Figure 4:
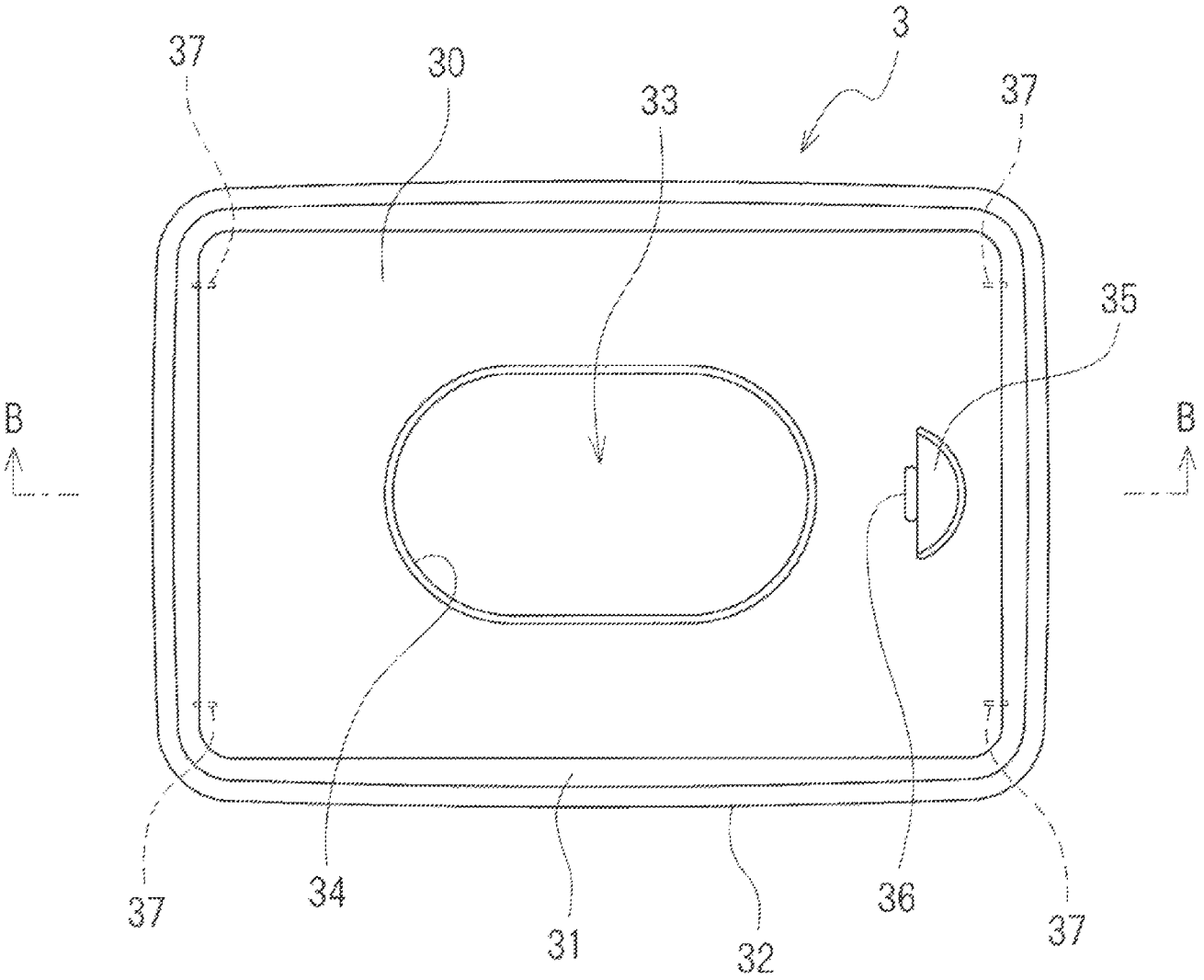
FIG. 4 is a plan view illustrating a case as a packaging container used for the packaging body.

The ceiling part 30 includes the dispensing opening 33 from which the wet sheet 1 can be taken out. The dispensing opening 33 is opened in a center part of the ceiling part 30. The dispensing opening 33 may be arbitrarily shaped. It is preferable that the dispensing opening 33 is shaped to be long along the long side direction of the ceiling part 30. In the present embodiment, the dispensing opening 33 has a track shape to be long in the long side direction of the ceiling part 30, as illustrated in FIG. 4. At an opened edge 33*a* of the dispensing opening 33, an annular projection 34 is projected downward. The annular projection 34 is formed over an entire circumference of the opened edge of the dispensing opening 33. The annular projection 34 extends to be inclined toward a center side of the dispensing opening 33, from an outer surface side of the ceiling part 30 to an inner surface side thereof. A tip end part of the annular projection 34 is locally thick. A distal end surface of the annular projection 34 is a surface curved downward along a thickness direction of the annular projection 34.

Further, in the vicinity of a first end, out of both ends in the long side direction of the ceiling part 30, a concave part 35 is formed. The concave part 35 is located between the first end in the long side direction of the ceiling part 30 and the dispensing opening 33. The concave part 35 is located at a center part in the short side direction of the ceiling part 30. The concave part 35 may be arbitrarily shaped. In the present embodiment, a shape of the concave part 35 is a tongue piece shape or a semicircular shape curved toward a side of the first end in the long side direction of the ceiling part 30. The shape of the concave part 35 is a tongue piece shape or a semicircular shape curved from the dispensing opening 33 toward a far side. In the vicinity of the top surface of the ceiling part 30 or an end at a side closer to the dispensing opening 33 of the concave part 35, a convex part 36 protruding upward is formed. It is noted that the convex part 36 and the concave part 35 are continuous with each other.

The side surface part 31 includes four wall surfaces to correspond to the shape of the ceiling part 30. The side surface part 31 includes a pair of front and rear wall surfaces to correspond to a pair of long sides of the ceiling part 30 and a pair of left and right wall surfaces to correspond to a pair of short sides of the ceiling part 30. A rib may be formed on an inner surface of the side surface part 31. The rib may be arbitrarily located and shaped, and may be prepared as many as desired, for example. In the present embodiment, on the inner surface of the side surface part 31, vertical ribs 37 extending in a longitudinal direction are formed. The vertical ribs 37 extend downward, by a predetermined length, from an upper end of the inner surface of the side surface part 31. Upper ends of the vertical ribs 37 reach the ceiling part 30. The vertical ribs 37 are formed on the pair of left and right wall surfaces, out of the four wall surfaces of the side surface part 31. A total of four vertical ribs 37 are formed, that is, each of the vertical ribs 37 is formed in the vicinity of both front and rear ends of the pair of left and right wall surfaces. It is noted that lengths of the vertical ribs 37 may be also arbitrarily set. In the present embodiment, the length of each of the vertical ribs 37 is ⅓ to ½ a dimension in an up-down direction of the side surface part 31. Each of the vertical ribs 37 is formed in an upper part only of the inner surface of the side surface part 31.

It is preferable that the case 3 is made of a synthetic resin. The case 3 is an injection molded product. When the bottom lid 4 is heat sealed to the case 3, the synthetic resin forming the case 3 can heat seal the bottom lid 4. The synthetic resin may include a polypropylene resin (PP), for example. It is noted that the case 3 may be a sheet molded product made by shaping a sheet made of the synthetic resin. Examples of the shaping of a sheet include vacuum forming, air pressure forming, and press forming. In particular, the vacuum forming is preferable on cost aspect. The synthetic resin sheet includes various types of thermoplastic resin sheets. The thermoplastic resin sheet is a sheet made of a polyethylene terephthalate resin, a polystyrene resin, a polyethylene resin, a polypropylene resin, and a polycarbonate resin, for example. It is preferable that the synthetic resin sheet is thick. A thickness of the sheet is 0.5 mm to 2.5 mm, for example.

<Bottom Lid 4>

In the present embodiment, the bottom lid 4 includes a film made of a synthetic resin. The film may be either a single-layered film or a multi-layered film. It is preferable that the film has a multi-layered structure. The bottom lid 4 is heat sealed to the lower end surface of the side surface part 31 of the case 3. In present embodiment, the flange part 32 is formed at the lower end of the side surface part 31 of the case 3. The bottom lid 4 is heat sealed to the bottom surface of the flange part 32. The bottom lid 4 is heat sealed to the case 3, and thus, the film configuring the bottom lid 4 includes a sealant layer on the inner surface. It is preferable that the film configuring the bottom lid 4 has a gas barrier property. As an example, the film has a four-layered structure. The film includes a polyethylene terephthalate film (PET) as a base film, a PET film obtained through aluminum evaporation, as a gas barrier layer, a biaxially oriented polypropylene film (OPP), and a cast polypropylene film (CPP) as a sealant layer, in order from an outer surface side. A thickness of the PET film is 12 μm, for example. A thickness of the PET film obtained through aluminum evaporation is 12 μm, for example. A thickness of the OPP film is 50 μm, for example. A thickness of the CPP film is 40 μm, for example. It is noted that in the base film, various types of print layers such as a pattern and a text may be formed.

<Flap 5>

The flap 5 is affixed to the ceiling part 30 of the case 3 to cover the dispensing opening 33 of the case 3. The flap 5 is affixed in a peelable and re-affixable manner to the ceiling part 30 of the case 3. The flap 5 may be arbitrarily shaped to cover the dispensing opening 33. A size of the flap 5 is larger than that of the dispensing opening 33. The dispensing opening 33 is shaped to be long along the long side direction of the ceiling part 30 of the case 3. The shape of the flap 5 corresponds to that of the dispensing opening 33. The flap 5 is shaped to be long along the long side direction of the ceiling part 30 of the case 3. Specifically, the shape of the flap 5 is in an oblong. A longitudinal direction of the flap 5 is the direction of peeling of the flap 5. The longitudinal direction of the flap 5 is the direction of opening of the flap 5. The flap 5 is peeled along the long side direction of the ceiling part 30 of the case 3. A first end, out of both ends in the longitudinal direction of the flap 5, is an end at a side where the peeling starts. At the first end in the longitudinal direction of the flap 5, a pinched part 50 is arranged. A shape of the pinched part 50 is a semicircle, for example. As illustrated in FIG. 2, the pinched part 50 is located above the concave part 35 of the ceiling part 30 of the case 3. The pinched part 50 is located above the convex part 36. As illustrated in FIG. 3, when the pinched part 50 abuts against the convex part 36, the pinched part 50 is gradually raised upward toward a tip end side of the pinched part 50. The pinched part 50 is located above the concave part 35. However, a whole of the concave part 35 is not covered from above with the pinched part 50. As illustrated in FIG. 2, a part of the concave part 35, which is not covered with the pinched part 50, is exposed. A rear surface of the flap 5 has adhesion. On a rear surface of the flap 5, the flap 5 includes an adhesive part having adhesion. The rear surface of the flap 5 can be peeled from and re-affixed to the case 3. The rear surface of the pinched part 50 has no adhesion. On the rear surface of the pinched part 50, the pinched part 50 includes a non-adhesive part having no-adhesion. A portion corresponding to the dispensing opening 33, out of the rear surface of the flap 5, is a non-adhesive part.

At a second end side, out of the both ends in the longitudinal direction of the flap 5, a cut line for stopper 51 configured to stop the flap 5 from peeling is formed. The cut line for stopper 51 is formed at each of the both ends in a short direction of the flap 5. Both the cut line for stoppers 51 extend internally from the both ends in the short direction of the flap 5.

The flap 5 has a multi-layered structure. The flap 5 includes a base film and an adhesive layer layered on the rear surface of the base film. On the front surface of the base film, a print layer is formed. The base film includes various types of flexible film. In particular, the base film includes various transparent synthetic resin films. It is preferable that the base film is a biaxially oriented polyethylene terephthalate film. It is noted that the base film may be paper, nonwoven fabric, synthetic paper, and the like. The adhesive layer may be formed by applying various types of adhesives to the rear surface of the base film. It is noted that the adhesive layer is formed over an entire rear surface of the base film. On a rear surface of the pinched part 50, a masking agent such as ultraviolet-curable ink is applied on the adhesive layer. The rear surface of the pinched part 50 may be processed as a non-adhesive part. Likewise, out of the rear surface of the flap 5, a location corresponding to the dispensing opening 33 may be also a non-adhesive part.

<Manufacturing Process>

Subsequently, a process of manufacturing the packaging body will be explained. Firstly, as illustrated in FIG. 6(*b*), the inner bag 2 is expanded into a rectangular tube-like shape. The bottom part 21 of the inner bag 2 is placed downward, and the opening part 24 of the inner bag 2 is placed upward. For example, the inner bag 2 is placed on a placement surface of a table and the like. The expanded inner bag 2 is in a rectangular shape in plan view as seen from a side of the opening part 24. In particular, the expanded inner bag 2 is in an oblong shape in plan view as seen from a side of the opening part 24. The inner bag 2 is a lateral gusset bag, and thus, the bottom part 21 of the inner bag 2 can be easily formed into a rectangular shape. The inner bag 2 is a lateral gusset bag, and thus, the bottom part 21 of the inner bag 2 can be easily formed into an oblong shape. Even when the film of the inner bag 2 is a thin film lacking rigidity such as PE, the end 25 at the side of the opening part 24 can easily maintain a standing position.

Figure 7:
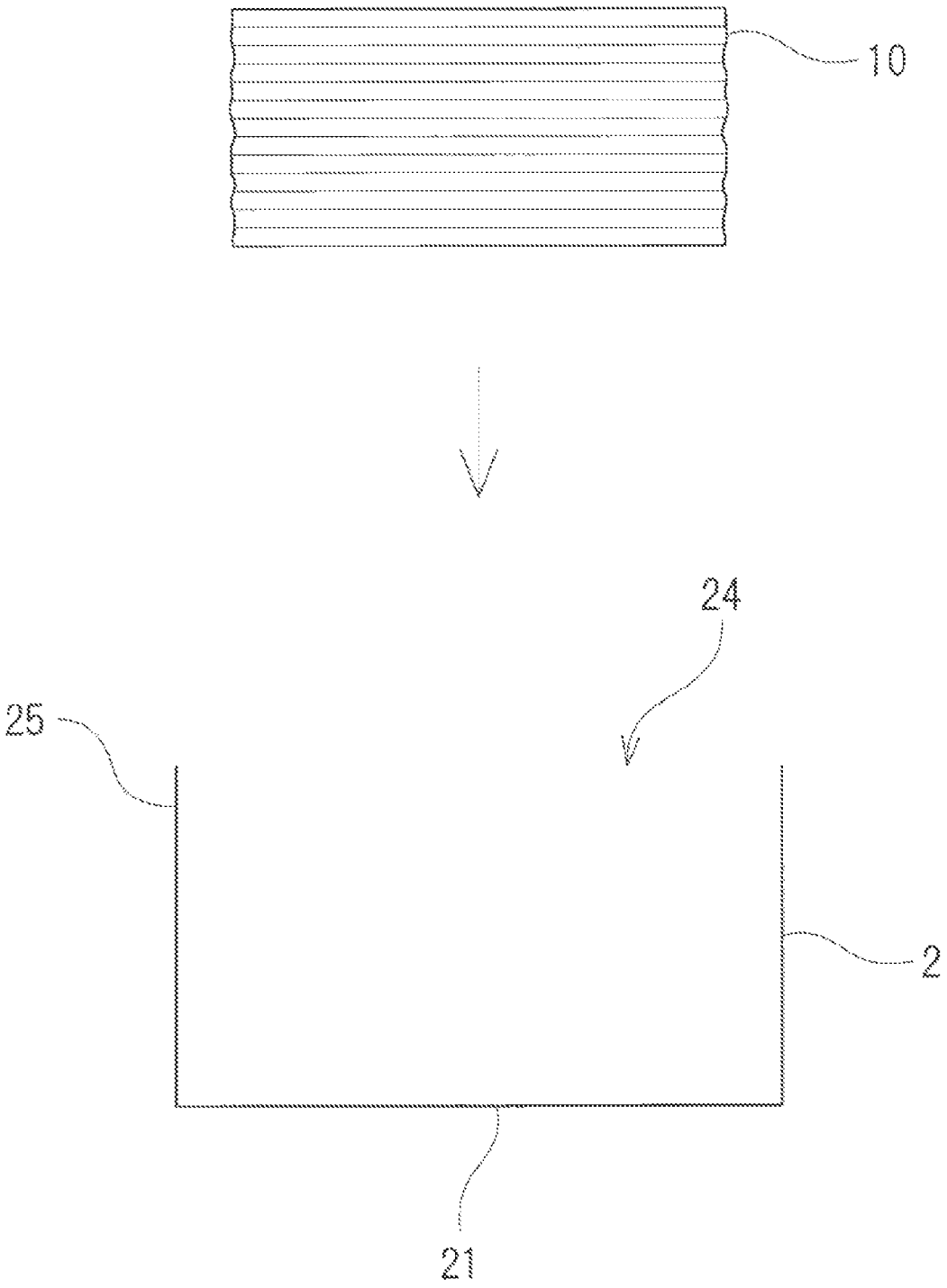
FIG. 7 is a cross-sectional view illustrating a manufacturing process of the packaging body.

On the other hand, as illustrated in FIG. 7, a plurality of folded sheet base materials 10 are vertically layered. The plurality of layered sheet base materials 10 are placed into the inner bag 2. The number of the sheet base materials 10 is preferably 10 or more. The number of the sheet base materials 10 is from 10 to 100. The inner bag 2 is a lateral gusset bag, and thus, the plurality of sheet base materials 10 can be easily and collectively placed into the inner bag 2. When the sheet base materials 10 are placed into the inner bag 2, the sheet base materials 10 are hardly deformed. Therefore, when the wet sheet 1 is taken out from the dispensing opening 33, the wet sheet 1 can be taken out smoothly.

Figure 8:
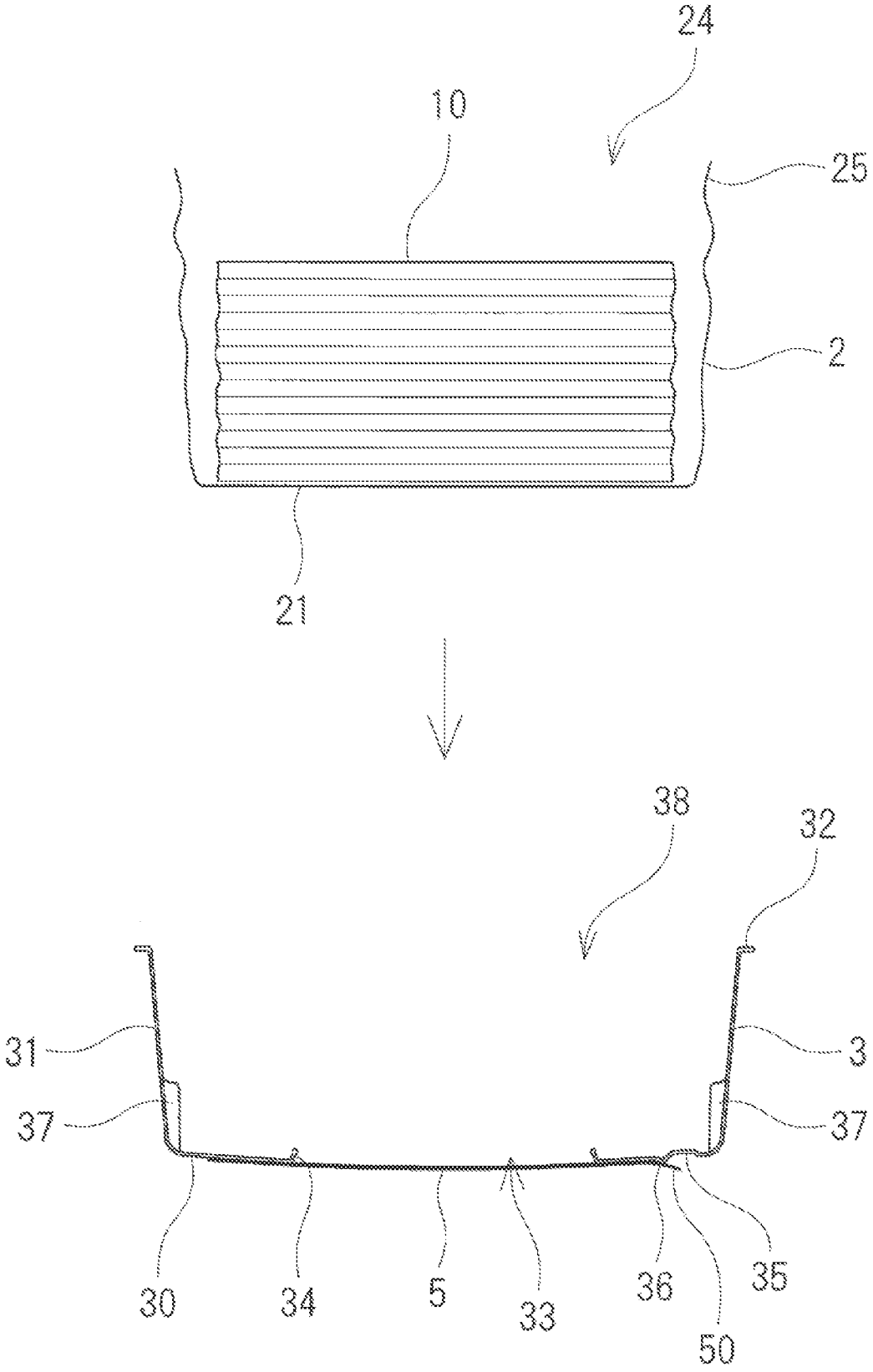
FIG. 8 is a cross-sectional view illustrating a manufacturing process of the packaging body.

As illustrated in FIG. 8, the plurality of vertically layered sheet base materials 10 are placed into the inner bag 2. The end 25 at the side of the opening part 24 of the inner bag 2 protrudes upward by a predetermined length than the top surface of the plurality of sheet base materials 10. As illustrated in FIG. 6(*b*) and FIG. 7, while the bottom part 21 of the inner bag 2 is set to be flat, a vertical dimension from the bottom part 21 of the inner bag 2 to the opening part 24 of the inner bag 2 is larger than that of the plurality of sheet base materials 10. As illustrated in FIG. 6(*b*) and FIG. 7, while the bottom part 21 of the inner bag 2 is set to be flat, a vertical dimension from the bottom part 21 of the inner bag 2 to the opening part 24 of the inner bag 2 has a margin relative to that of the plurality of sheet base materials 10.

On the other hand, the top and the bottom of the case 3 is inverted. The bottom surface opening part 38 of the case 3 is placed upward. The flap 5 is previously affixed to the dispensing opening 33 of the case 3. The inner bag 2 in which the plurality of sheet base materials 10 are placed is placed into the case 3. The case 3, which is made of a hard synthetic resin, has shape retainability. Thus, the plurality of sheet base materials 10 placed in the inner bag 2 can be easily housed in the case 3. The inner bag 2 is placed into the case 3 whose top and bottom is inverted from the side of the bottom part 21, and thus, the inner bag 2 can be smoothly placed into the case 3.

Figure 9A:
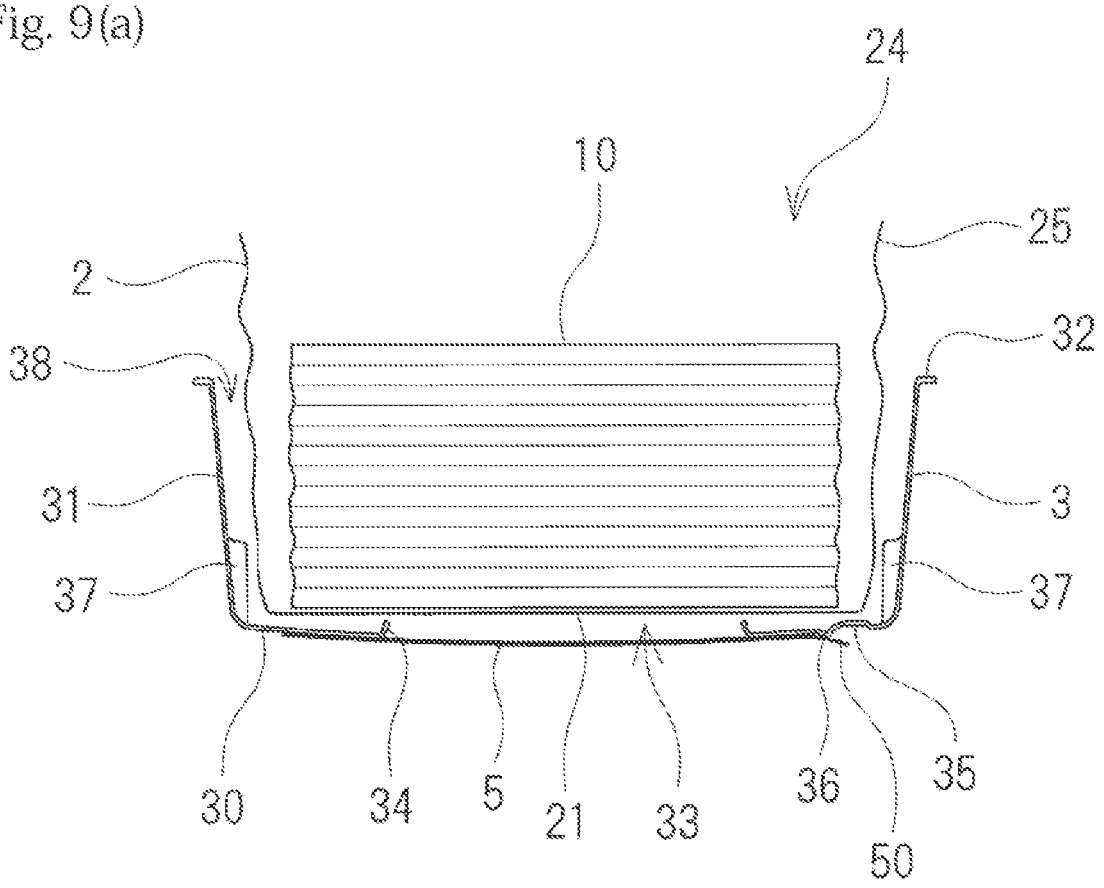
FIGS. 9(*a*) and 9(*b*) are cross-sectional views each illustrating a manufacturing process of the packaging body.
Figure 9B:
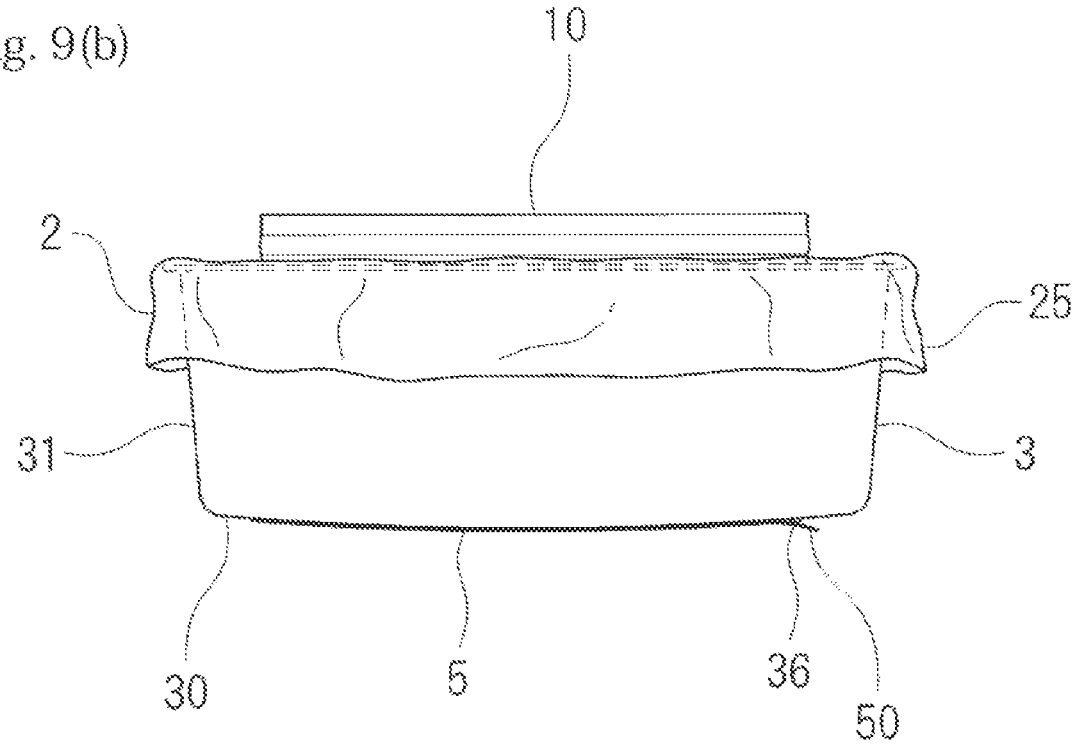

The bottom part 21 of the inner bag 2 is directed downward. The ceiling part 30 of the case 3 faces a lower side. When the inner bag 2 into which the plurality of sheet base materials 10 are placed is placed in the case 3, as illustrated in FIG. 9(*a*), the bottom part 21 of the inner bag 2 confronts the ceiling part 30 of the case 3. The bottom part 21 of the inner bag 2 is supported by the annular projection 34. Thus, the bottom part 21 of the inner bag 2 is lifted up from the inner surface of the ceiling part 30 of the case 3, and the bottom part 21 of the inner bag 2 does not adhere to the inner surface of the ceiling part 30 of the case 3. Both the bottom surface opening part 38 of the case 3 and the opening part 24 of the inner bag 2 face upward. The plurality of vertically layered sheet base materials 10 in a state of being housed in the case 3 protrude upward, by a predetermined amount, from the flange part 32 of the case 3. The end 25 at the side of the opening part 24 of the inner bag 2 protrudes upward, by a predetermined length, from the flange part 32 of the case 3. The inner bag 2 protrudes upward by a predetermined length from the case 3. A portion where the inner bag 2 protrudes from the case 3 is a margin of the inner bag 2 with respect to the case 3. A length of the margin is 20 to 25 mm, for example, at the long side. The length of the margin is 25 to 30 mm, for example, at the short side. As illustrated in FIG. 9(*b*), the end 25 at the side of the opening part 24 of the inner bag 2 is folded downward at the flange part 32 of the case 3. The end 25 at the side of the opening part 24 of the inner bag 2 is positioned outside the side surface part 31 of the case 3.

Figure 10:
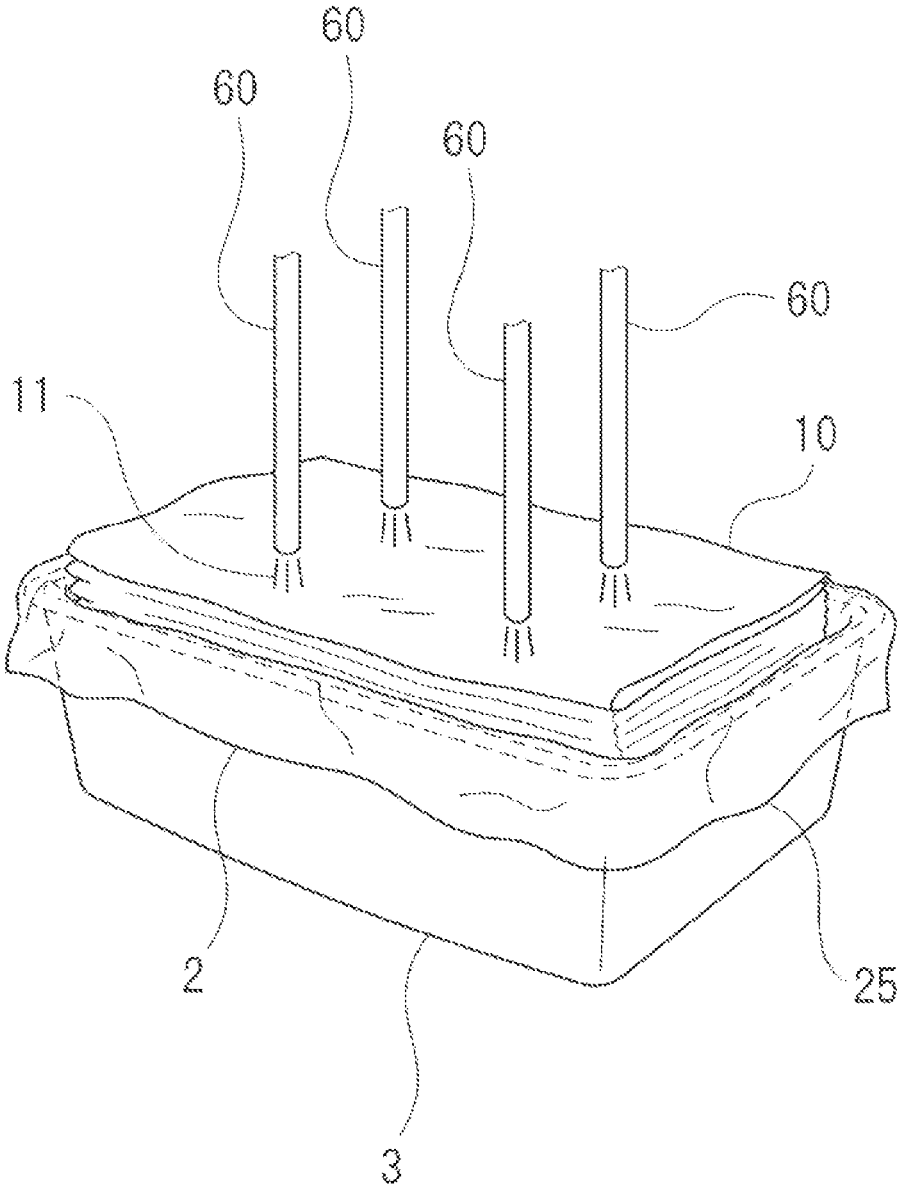
FIG. 10 is a perspective view illustrating a manufacturing process of the packaging body.

Thereafter, the liquid 11 is fed into the inner bag 2. Specifically, as illustrated in FIG. 10, a nozzle 60 is placed above the layered sheet base materials 10. The liquid 11 is supplied from the nozzle 60 toward the sheet base materials 10. Preferably, a plurality of nozzles 60 are placed. Preferably, four or two nozzles 60 are placed. FIG. 10 illustrates a case where the four nozzles 60 are placed. When the four nozzles 60 are placed above the sheet base materials 10, the nozzles 60 are placed to have intervals respectively in two directions, that is, the long side direction and the short side direction, of the case 3. It is noted that when the two nozzles 60 are used, for example, the nozzles 60 are preferably arranged at a center part in the short side direction of the case 3 with the intervals in the long side direction of the case 3. It is preferable that the liquid 11 is fed to the top surface of the layered sheet base materials 10. It is preferable that the liquid 11 is fed to the inner bag 2 via the sheet base materials 10. Outside the inner bag 2, the hard case 3 is present. Thus, when the liquid 11 is fed to the inner bag 2, the liquid 11 can be easily fed while the plurality of sheet base materials 10 can retain its shape. The end 25 at the side of the opening part 24 of the inner bag 2 is folded downward at the flange part 32 of the case 3 to be placed outside the side surface part 31 of the case 3, and thus, the inner bag 2 does not interfere when the liquid 11 is fed. The inner bag 2 can prevent the liquid 11 from adhering to the flange part 32 of the case 3 or surface to be heat sealed.

Figure 11A:
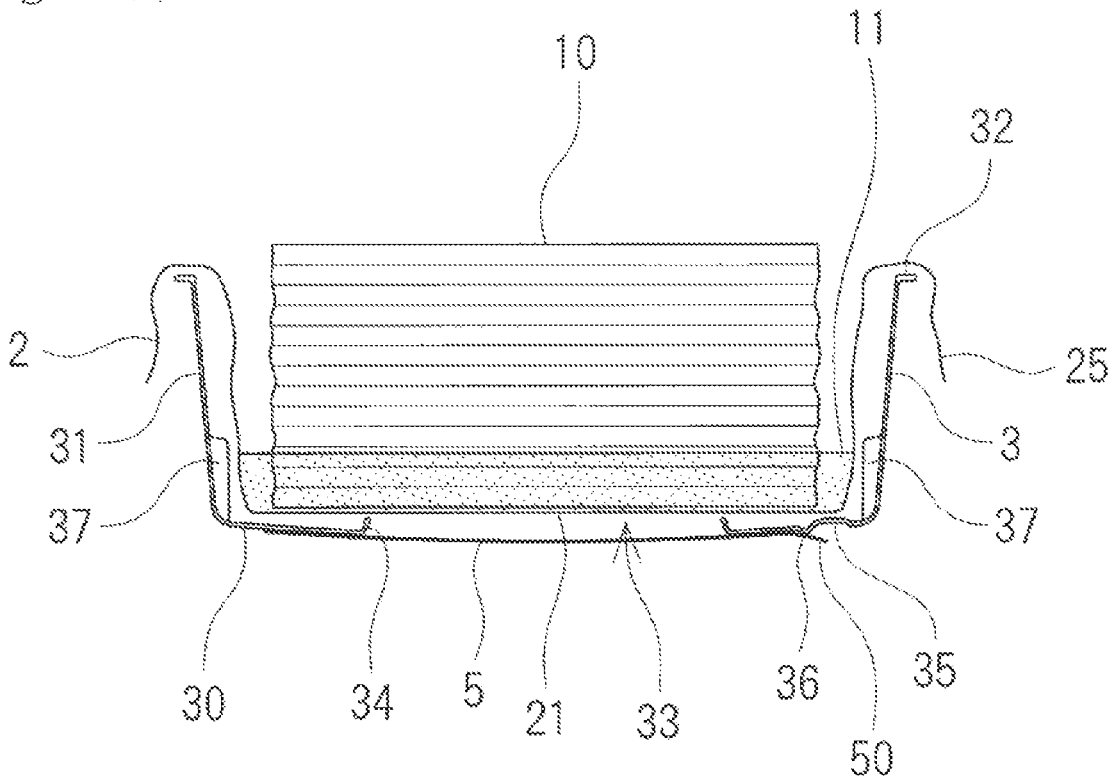
FIGS. 11(*a*) and 11(*b*) are cross-sectional views each illustrating a manufacturing process of the packaging body.
Figure 11B:
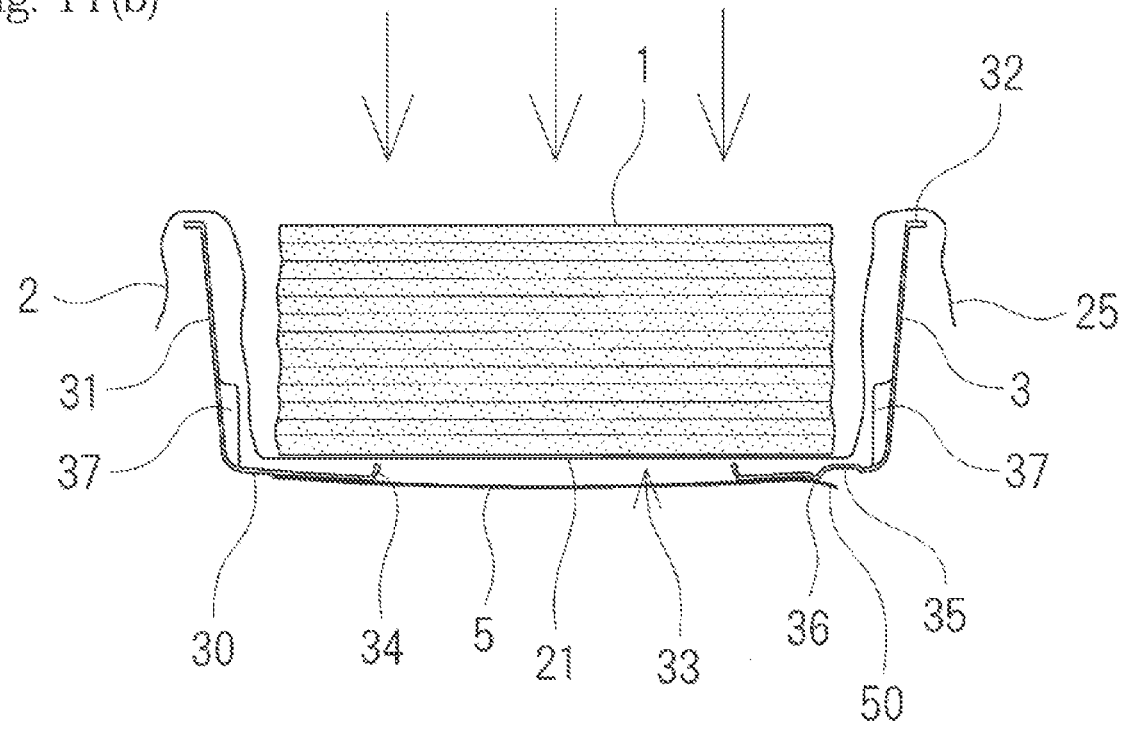

A quantity of the liquid 11 is about ⅕ to ¼ the vertical dimension of the case 3, as illustrated in FIG. 11(*a*), for example. As illustrated in FIG. 11(*b*), the quantity of the liquid 11 is such that the liquid 11 can penetrate through a whole of the plurality of sheet base materials 10. The inner bag 2 is present between the sheet base materials 10 and the case 3, and thus, the liquid 11 cannot reach the case 3. The liquid 11 does not reach the dispensing opening 33 of the case 3. The adhesive power of the flap 5 will not decrease due to the liquid 11.

When the sheet base material 10 is impregnated with the liquid 11, the wet sheets 1 are completed. After the liquid 11 is fed, as illustrated in an arrow in FIG. 11(*b*), the wet sheets 1 are preferably pressed from above. Through this pressing step, the liquid 11 is spread over to a whole of the plurality of wet sheets 1. The plurality of wet sheets 1 protruding by a predetermined amount above the flange part 32 of the case 3 are compressed by the pressing step. The plurality of wet sheets 1 will not protrude upward of the case 3. The plurality of wet sheets 1 are completely housed inside the case 3. A height of the top surface of the plurality of housed wet sheets 1 is equal to or less than the bottom surface of the flange part 32 of the case 3. The plurality of wet sheets 1 are compressed vertically to be completely housed in the case 3. When the bottom lid 4 is heat sealed to the flange part 32, the center part of the bottom lid 4 will not swell upward as a result of being pressed by the wet sheets 1. The bottom lid 4 can be surely heat sealed to the flange part 32. The annular projection 34 supports the inner bag 2 from below, and thus, a weight of the wet sheets 1 itself or a pressing force in the pressing step does not act on the flap 5. Therefore, the flap 5 can be prevented from peeling.

Figure 12A:
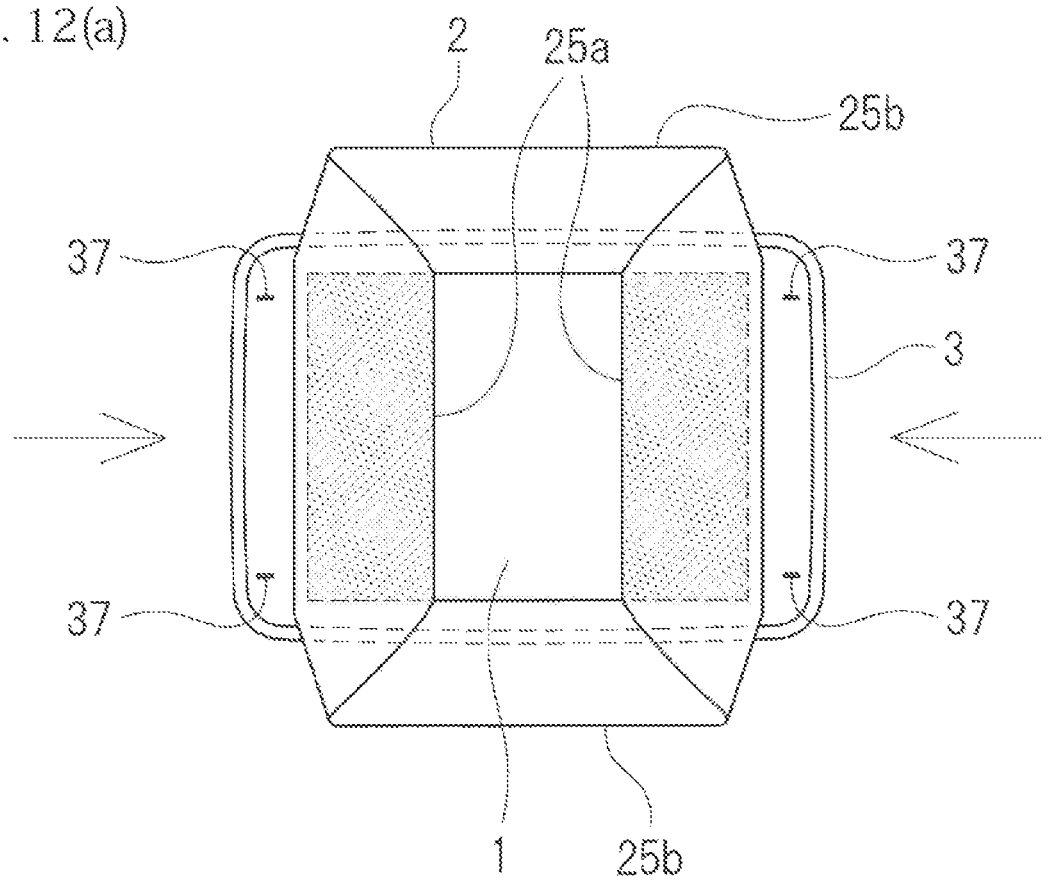
FIGS. 12(*a*) and 12(*b*) are plane views each illustrating a manufacturing process of the packaging body.
Figure 12B:
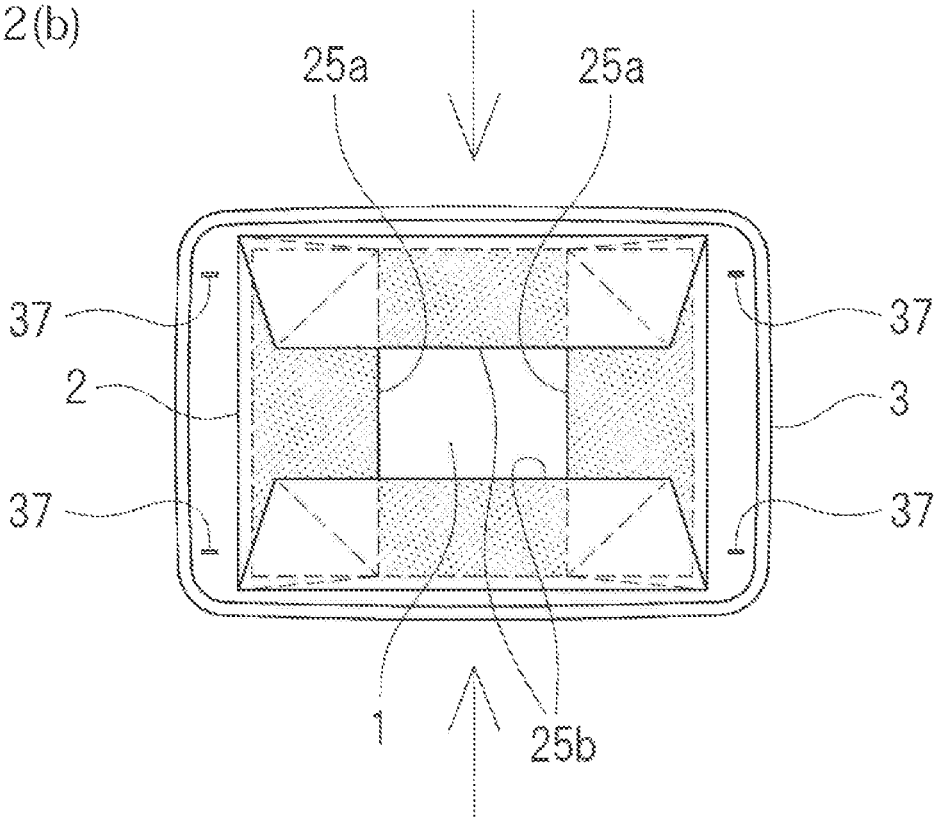

Thereafter, the process advances to a step of folding the inner bag 2, as illustrated in FIGS. 12(*a*) and 12(*b*). A vertical length of the inner bag 2 is sufficiently prepared for a layering height of the plurality of wet sheets 1. The sufficiently prepared length can be utilized when the inner bag 2 is folded. Firstly, the end 25 at the side of the opening part 24 of the inner bag 2 that has been folded outward of the flange part 32 of the case 3 is lifted up to keep an upright position. In that upright position, the end 25 at the side of the opening part 24 of the inner bag 2 is in a rectangular shape in plan view. Specifically, the end 25 at the side of the opening part 24 of the inner bag 2 is in an oblong shape. The end 25 at the side of the opening part 24 of the inner bag 2 in the upright position is folded by approximately 90 degree toward inside the case 3. The end 25 may be folded in any manner. An example in which the end 25 is folded is as follows. Firstly, as illustrated in FIG. 12(*a*), portions 25*a* at a side of a pair of left and right short sides, out of the end 25 at the side of the opening part 24 of the inner bag 2, are each folded internally to be pressed against the lowermost wet sheet 1. It is noted that the top and the bottom of the case 3 is inverted in the manufacture stage. Thus, the lowermost wet sheet 1 is located on the top in the manufacture stage. The wet sheet 1 is impregnated with the liquid 11, and thus, the inner bag 2 adheres to the wet sheet 1. Thus, a folded state of the end 25 at the side of the opening part 24 of the inner bag 2 is maintained. In FIGS. 12(*a*) and 12(*b*), a portion where the lowermost wet sheet 1 and the inner bag 2 adhere strongly to each other is indicated with a large number of dots. As illustrated in FIG. 12(*a*), while the portions 25*a* at the side of the pair of left and right short sides, out of the end 25 at the side of the opening part 24 of the inner bag 2, are folded internally, the portions 25*a* at the short side, out of the end 25 at the side of the opening part 24 of the inner bag 2, are separated from each other.

Next, as illustrated in FIG. 12(*b*), portions 25*b* at a side of a pair of front and rear long sides, out of the end 25 at the side of the opening part 24 of the inner bag 2, are each folded internally to be pressed against the lowermost wet sheet 1 to be adhered strongly. At four corners in the end 25 at the side of the opening part 24 of the inner bag 2, the portions 25*b* in the end 25 at the long sides of the opening part 24 of the inner hag 2 are placed on the portions 25*a* at the short sides. A portion other than the four corners, out of the end 25 at the side of the opening part 24 of the inner bag 2, abuts against the lowermost wet sheet 1. The portion other than the four corners, out of the end 25 at the side of the opening part 24 of the inner bag 2, can be adhered strongly with the wet sheet 1. The portions 25*b* at the long side are also separated from each other in an internally folded state. The bottom surface of the plurality of vertically layered wet sheets 1 is the top surface when the top and the bottom thereof is inverted as illustrated in FIGS. 12(*a*) and 12(*b*). A center part of the bottom surface of the plurality of vertically layered wet sheets 1 is not covered with the inner bag 2 and is exposed. Only the center part of the bottom surface of the plurality of vertically layered wet sheets 1 is not covered with the inner bag 2. Other than the center part of the bottom surface of the plurality of vertically layered wet sheets 1, a whole of the plurality of vertically layered wet sheets 1 is covered with the inner bag 2.

Figure 13:
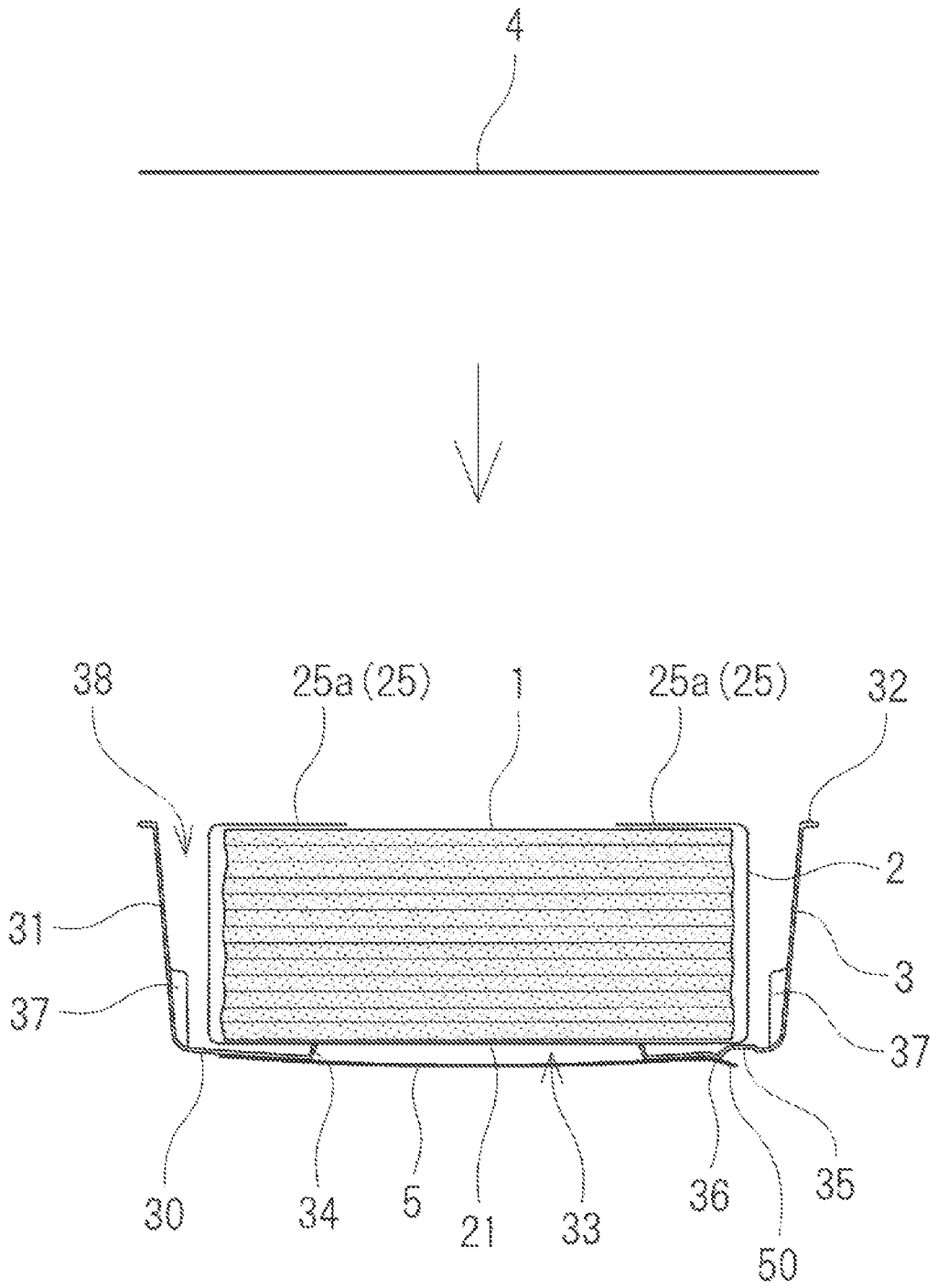
FIG. 13 is a cross-sectional view illustrating a manufacturing process of the packaging body.

Then, as illustrated in FIG. 13, the bottom lid 4 is heat sealed to the bottom surface of the flange part 32 of the case 3. The end 25 at the side of the opening part 24 of the inner bag 2 is internally folded. The end 25 at the side of the opening part 24 of the inner bag 2 is strongly adhered to the wet sheet 1. A state where the end 25 at the side of the opening part 24 of the inner bag 2 is folded is maintained. When the bottom lid 4 is heat sealed to the bottom surface of the flange part 32 of the case 3, the inner bag 2 does not interfere. When the bottom lid 4 is heat sealed to the bottom surface of the flange part 32 of the case 3, a seal bar will not contact the inner bag 2. When the bottom lid 4 is heat sealed to the bottom surface of the flange part 32 of the case 3, the inner bag 2 is not dissolved and not damaged. When the bottom surface opening part 38 of the case 3 is sealed with the bottom lid 4, the packaging body is completed. After the packaging body is manufactured, the top and the bottom of the packaging body is inverted. The packaging body is placed in a normal state in which the flap 5 is located on the top, as illustrated in FIG. 1.

In the manufactured packaging body, the plurality of vertically layered wet sheets 1 are placed into the inner bag 2. In transit, for example, before opened, the wet sheets 1 are hardly shifted in position and can easily retain its shape in the case 3. In particular, as the end 25 at the side of the opening part 24 of the inner bag 2 is folded, a state where the wet sheets 1 are layered can be appropriately retained.

In the normal state, the opening part 24 of the inner bag 2 faces downward. The liquid 11 impregnated into the wet sheet 1 may possibly leak out from the opening part 24 of the inner bag 2 to outside the inner bag 2. Even if the liquid 11 leaks out outside the inner bag 2, an amount of the liquid 11 to be leaked out is very small. The leaked liquid 11 can hardly rise along the side surface part 31 of the case 3. Thus, the liquid 11 does not reach the dispensing opening 33. A state where the flap 5 is affixed can be surely maintained. The end 25 at the side of the opening part 24 of the inner bag 2 is folded, and thus, the liquid 11 can be further prevented from leaking out from the inner bag 2. The folded end 25 at the side of the opening part 24 of the inner bag 2 is strongly adhered to the lowermost wet sheet 1. The folded end 25 at the side of the opening part 24 of the inner bag 2 is pressed against the bottom lid 4 by a weight of the plurality of wet sheets 1 themselves. Therefore, a state where the end 25 at the side of the opening part 24 of the inner bag 2 is folded is retained.

<Start of Use>

Figure 14:
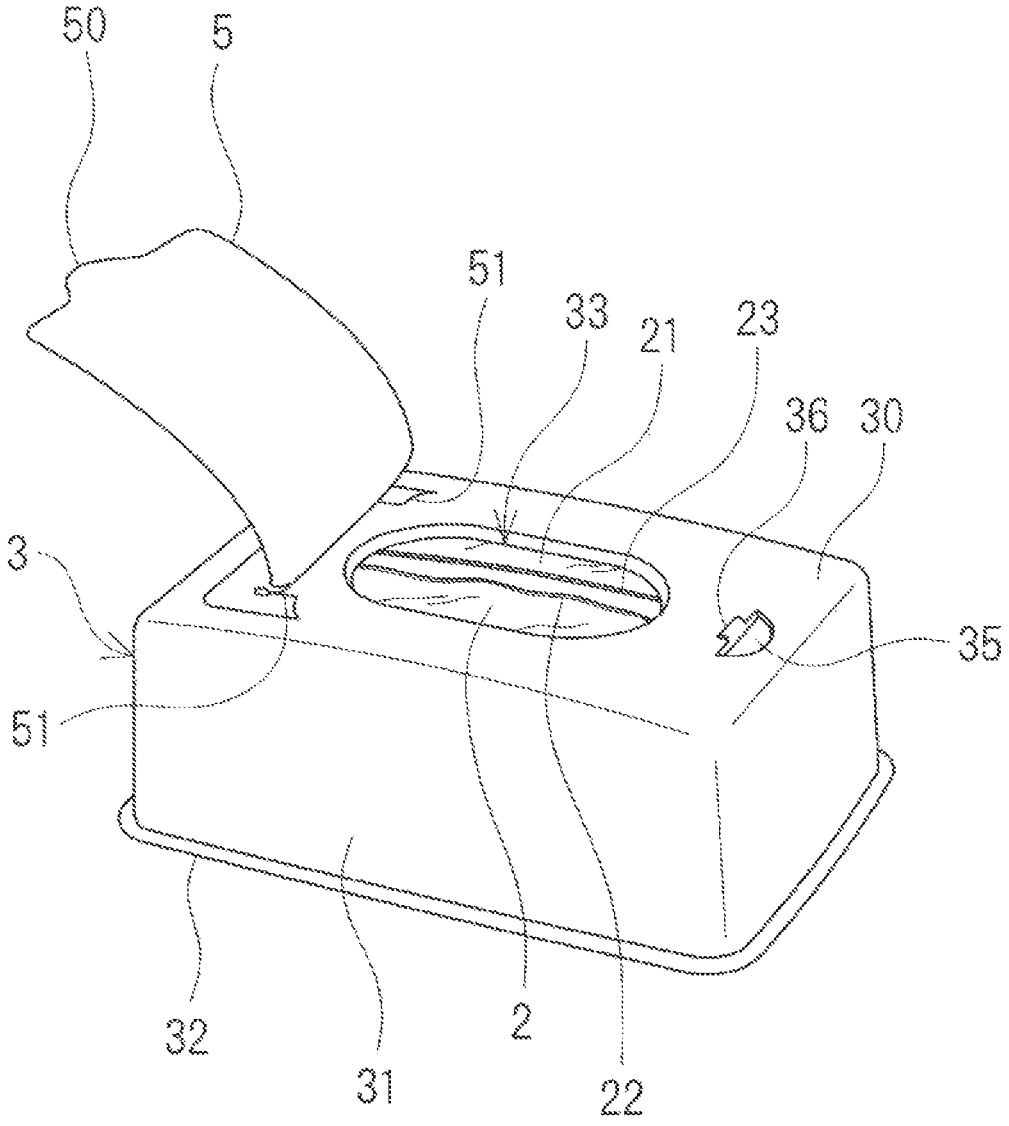
FIG. 14 is a perspective view illustrating a state of the packaging body at the time of starting use thereof and illustrating a state before the inner bag is taken out.
Figure 15:
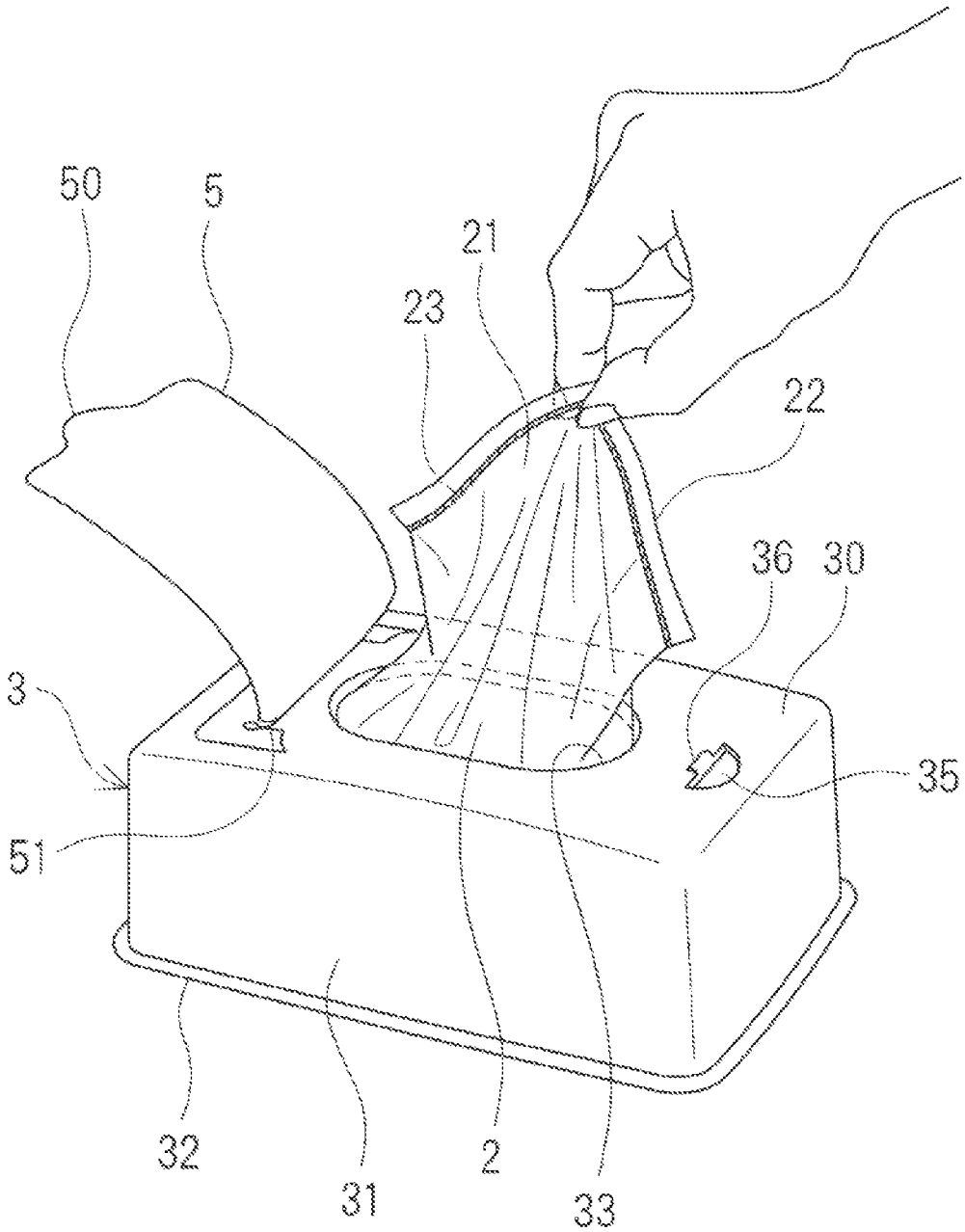
FIG. 15 is a perspective view illustrating a state of the packaging body at the time of starting use thereof and illustrating a state where the inner bag is being taken out.

When the packaging body is used, the flap 5 is firstly peeled from a first end side, as illustrated in FIG. 14, to open the dispensing opening 33. When the pinched part 50 of the flap 5 is pinched, the flap 5 can be peeled from the ceiling part 30 of the case 3. The concave part 35 is formed in the ceiling part 30 of the case 3. The convex part 36 is formed at the opened edge of the concave part 35. The pinched part 50 of the flap 5 is climbed upward by the convex part 36. Thus, when the flap 5 is peeled, the pinched part 50 can be easily pinched to peel the flap 5. When the flap 5 is opened, the bottom part 21 of the inner bag 2 is exposed partially from the dispensing opening 33 and the protrusion piece 22 of the bottom part 21 is also partially exposed. Thereafter, the inner bag 2 is pulled out from the dispensing opening 33, as illustrated in FIG. 15. The bottom part 21 of the inner bag 2 is placed upward, and thus, the inner bag 2 can be easily pulled out from the bottom part 21. In the bottom part 21 of the inner bag 2, the protrusion piece 22 is formed. The protrusion piece 22 is exposed from the dispensing opening 33. The protrusion piece 22 can be pinched with a fingertip to easily pull out the inner bag 2. The protrusion piece 22 inclines toward a single surface side. While the protrusion piece 22 is pinched to be pulled up, the protrusion piece 22 is pulled upward. The inner bag 2 is completely taken out from the case 3 for removal. The inner bag 2 taken out from the case 3 may be abandoned for disposal.

When the inner bag 2 is made of a polyethylene film, a resistance generated when the inner bag 2 is pulled out is small and the inner bag 2 can be therefore pulled out smoothly. Further, when the inner bag 2 is pulled out from the case 3, the inner bag 2 can be pinched and pulled out with a second hand while the side surface part 31, for example, of the case 3 is held with a first hand. The case 3 has a good shape retainability, and thus, the inner bag 2 can be easily pulled out while the case 3 is firmly held for fixation. The downward facing annular projection 34 is formed at the opening edge of the dispensing opening 33, and thus, the inner bag 2 can be pulled out from the dispensing opening 33 while contacting the distal end surface of the annular projection 34. As a result, the inner bag 2 can be pulled out smoothly. The distal end surface of the annular projection 34, is warped downward to form a curved surface, and therefore, a sliding resistance between the inner bag 2 and the distal end surface of the annular projection 34 is small. The distal end of the annular projection 34 is thick, and thus, the distal end surface of the annular projection 34 can be a large curved surface. Thus, the inner bag 2 smoothly slides against the distal end surface of the annular projection 34. Further, the annular projection 34 projects downward from the inner surface of the ceiling part 30 of the case 3, and thus, the inner bag 2 does not strongly adhere to the inner surface of the ceiling part 30 of the case 3. Thus, the inner bag 2 can be taken out easily. Further, the center part 1*b* of the bottom surface 1*c* of the wet sheet 1 is not covered with the inner bag 2 and is exposed as shown in FIG. 3, and thus, as compared to a structure in which a whole of the bottom surface of the wet sheet 1 is covered with the inner bag 2, the inner bag 2 can be pulled out easily.

After the inner bag 2 is pulled out, the wet sheet 1 can be used by taking out, from the dispensing opening 33, each of the wet sheets 1 from the wet sheet 1 placed on the top in order. The annular projection 34 protrudes downward at the opening edge of the dispensing opening 33, and thus, the wet sheet 1 hardly adheres to the inner surface of the ceiling part 30 of the case 3 and each of the wet sheets 1 can be taken out smoothly. After taking out the wet sheet 1, when the flap 5 is affixed again to the ceiling part 30 of the case 3, the dispensing opening 33 can be sealed again. Even when only a small amount of wet sheets 1 is left, the shape of the packaging body is maintained by the case 3. The wet sheets 1 can be smoothly taken out until the last sheet. A good appearance of the packaging body can be also maintained. The annular projection 34 is provided to be projected downward at the opening edge of the dispensing opening 33, and thus, the wet sheet 1 hardly contacts the flap 5 and the adhesive power of the flap 5 is maintained.

In present embodiment, the plurality of sheet base materials 10 are housed in the inner bag 2, the inner bag 2 where the sheet base material 10 is housed is placed into the case 3, and thereafter, the liquid 11 is fed into the inner bag 2 to impregnate the sheet base material 10 with the liquid 11. However, the liquid 11 may be fed into the inner bag 2 where the sheet base material 10 is housed in a state before the inner bag 2 where the sheet base material 10 is housed is placed in the case 3 rather than in the state where the inner bag 2 where the sheet base material 10 is housed is placed in the case 3. The liquid 11 may be fed into the inner bag 2 first, and the sheet base material 10 may be placed into the inner bag 2 to impregnate the sheet base material 10 with the liquid 11. The sheet base material 10 may be previously impregnated with the liquid 11 before the sheet base material 10 is placed into the inner bag 2 to create the wet sheet 1, and the resulting wet sheet 1 may be placed into the inner bag 2. A task of placing the wet sheet 1 into the inner bag 2 may be performed outside the case 3, and the inner bag 2 may be placed in the case 3 first, and then, the wet sheet 1 may be placed into the inner bag 2.

Figure 16:
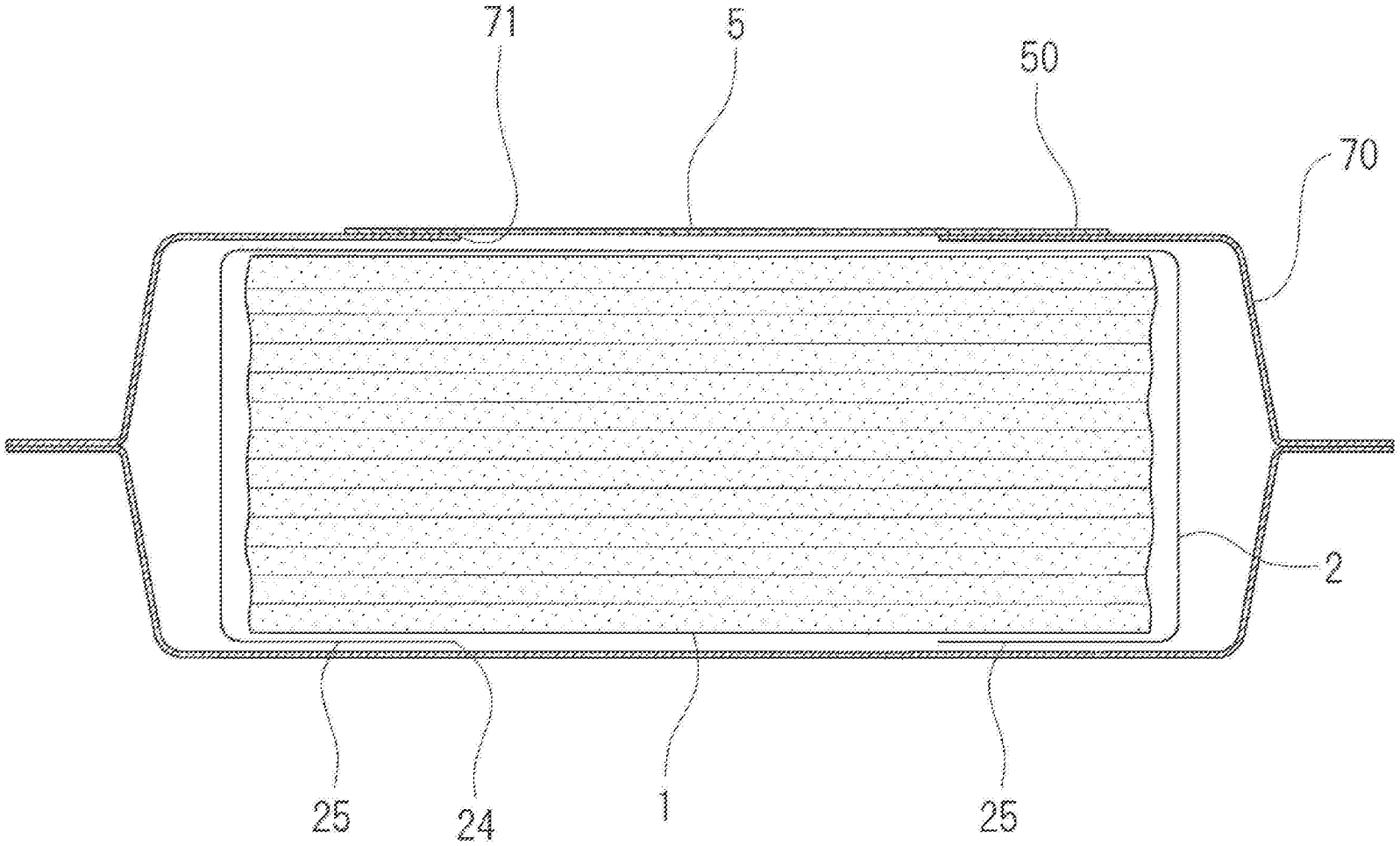
FIG. 16 is an end surface view corresponding to FIG. 3 illustrating a wet sheet packaging body in another embodiment of the present invention.
Figure 17A:
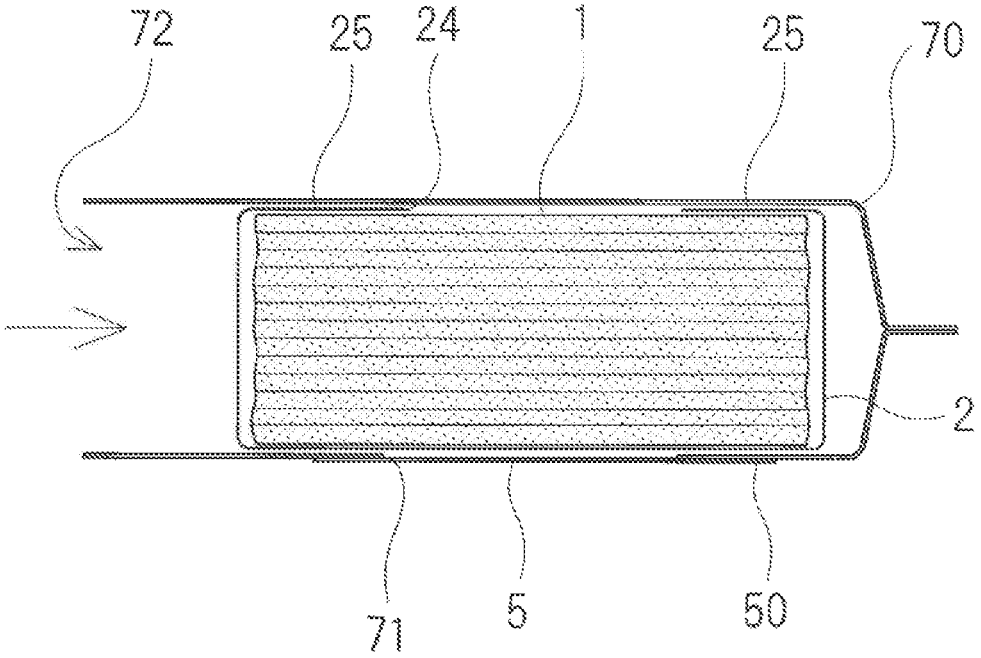
FIGS. 17(*a*) and 17(*b*) are cross-sectional dews each illustrating a manufacturing process of the packaging body.
Figure 17B:
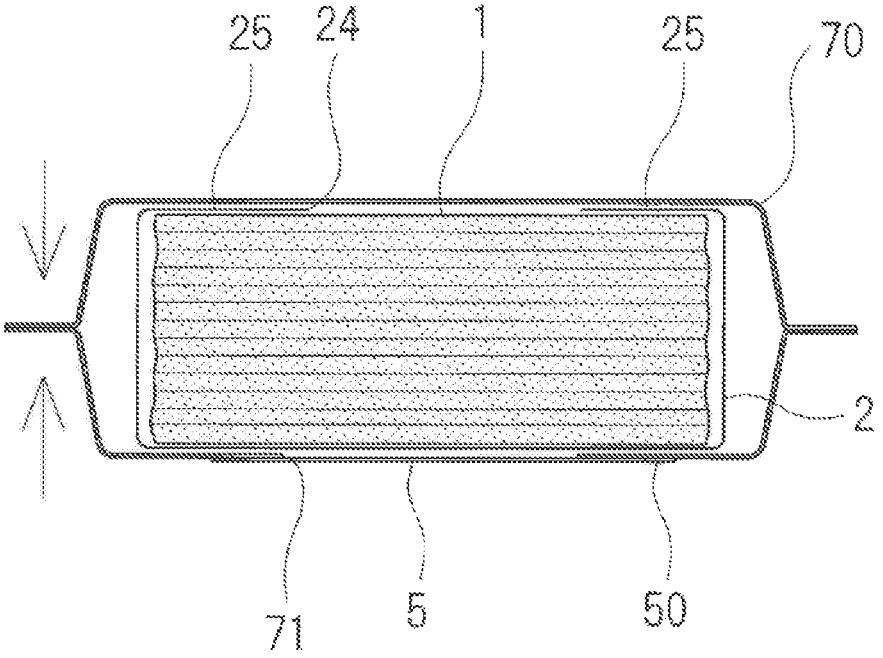

In the above embodiment, the packaging container is configured to include the case 3 and the bottom lid 4. However, the packaging container may have flexibility. For example, the packaging container is a packaging bag 70, as in FIG. 16. A form of the packaging bag 70 is arbitrary. The packaging bag 70 is a pillow packaging, for example. On a top surface of the packaging bag 70, a dispensing opening 71 is formed. The dispensing opening 71 is covered with the flap 5. When the packaging container is the packaging bag 70, for example, as illustrated in FIG. 17(*a*), a first end of the packaging bag 70 is opened. An opening part 72 of the packaging bag 70 faces toward its side. The inner bag 2 where the plurality of wet sheets 1 are placed is placed into the packaging bag 70 from its side. The top and the bottom of the packaging bag 70 is inverted. The flap 5 is located at its lower side. The bottom part 21 of the inner bag 2 is located at its lower side and the opening part 24 of the inner bag 2 is located at its upper side. The inner bag 2 where the bottom part 21 is located at its lower side and the opening part 24 is located at its upper side is placed into the packaging bag 70. The inner bag 2 where the plurality of wet sheets 1 are placed is placed into the packaging bag 70. Thereafter, as in FIG. 17(*b*), the opening part 72 of the packaging bag 70 is heat sealed to ensure sealing. Thereafter, the top and the bottom of the packaging bag 70 is inverted to achieve a normal state. When the packaging bag 70 is used, a manufacture cost of the packaging body can be further reduced.

Figure 18A:
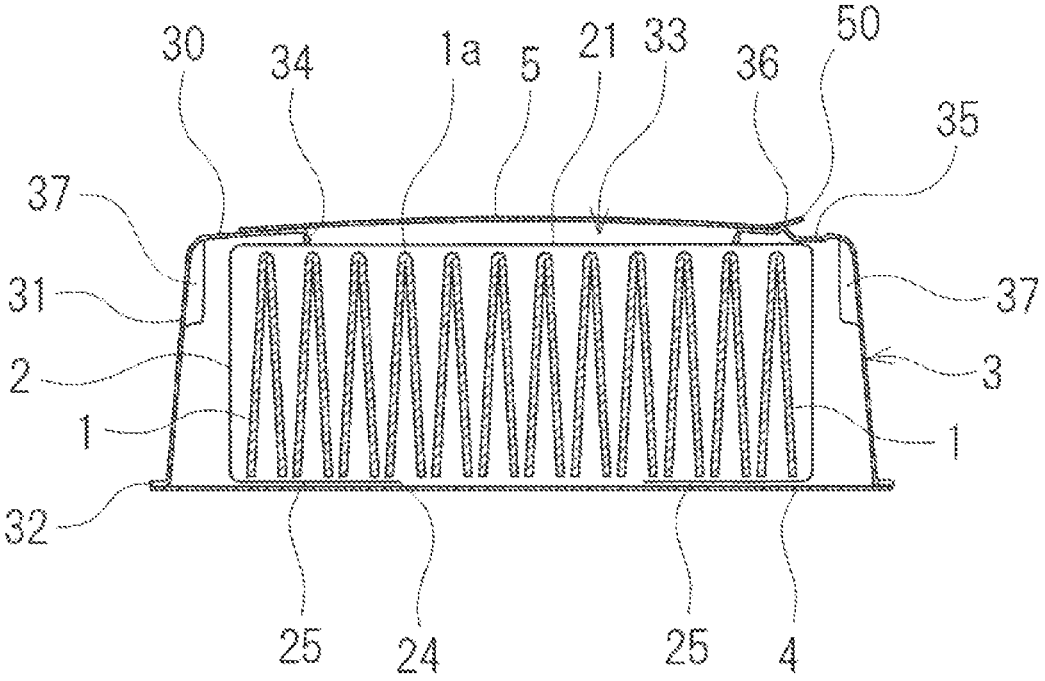
FIGS. 18(*a*) and 18(*b*) are end surface views each corresponding to FIG. 3 illustrating the wet sheet packaging body in the other embodiment of the present invention.
Figure 18B:
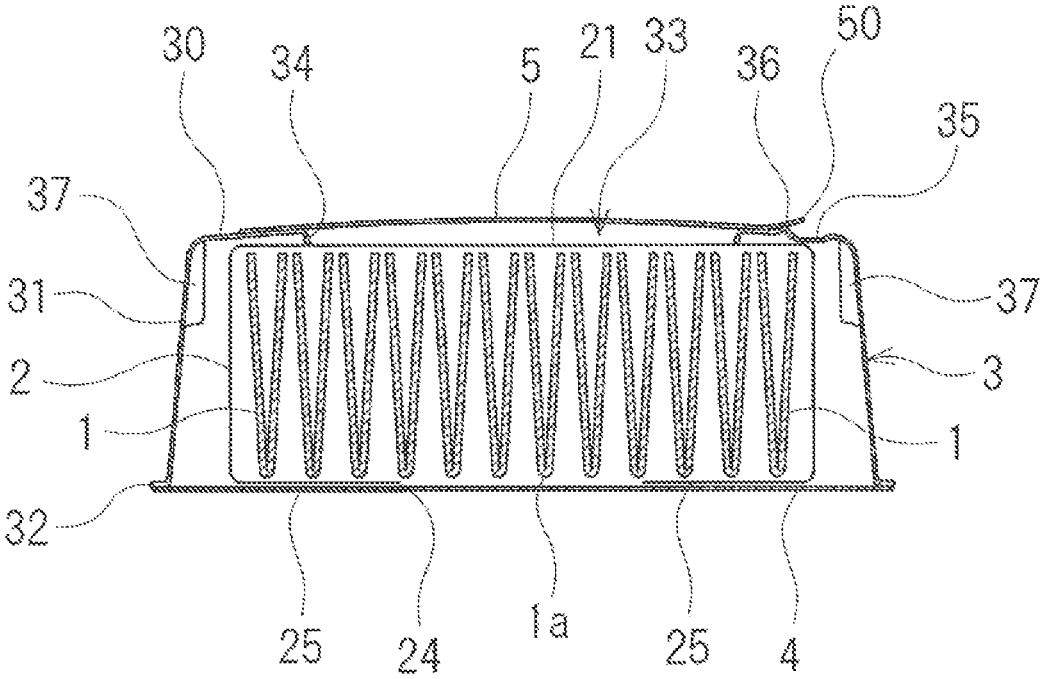
Figure 19A:
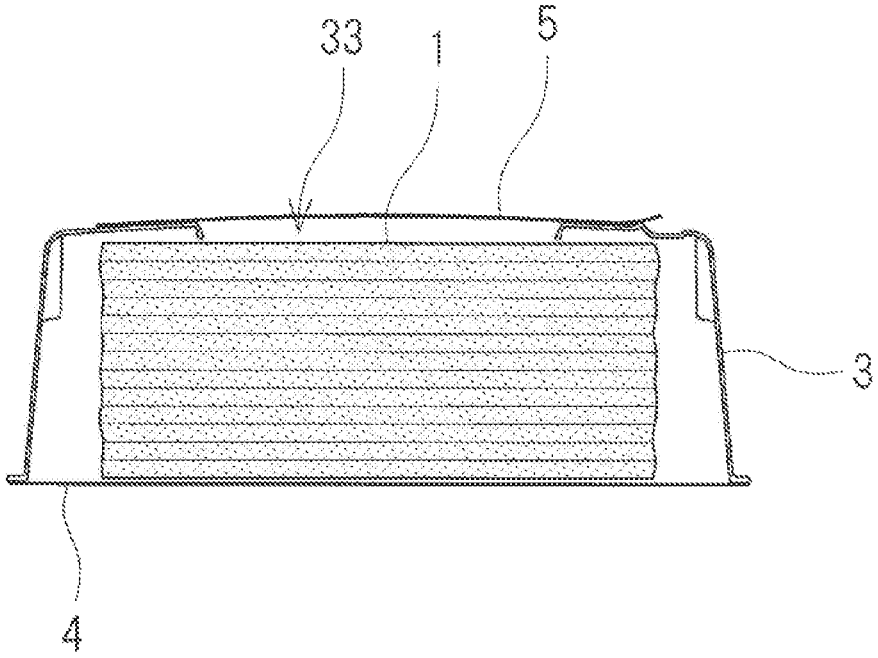
FIGS. 19(*a*) and 19(*b*) are cross-sectional views each illustrating a wet sheet packaging body as a reference example where FIG. 19(*a*) illustrates a normal state and FIG. 19(*b*) illustrates a state of a manufacturing stage.
Figure 19B:
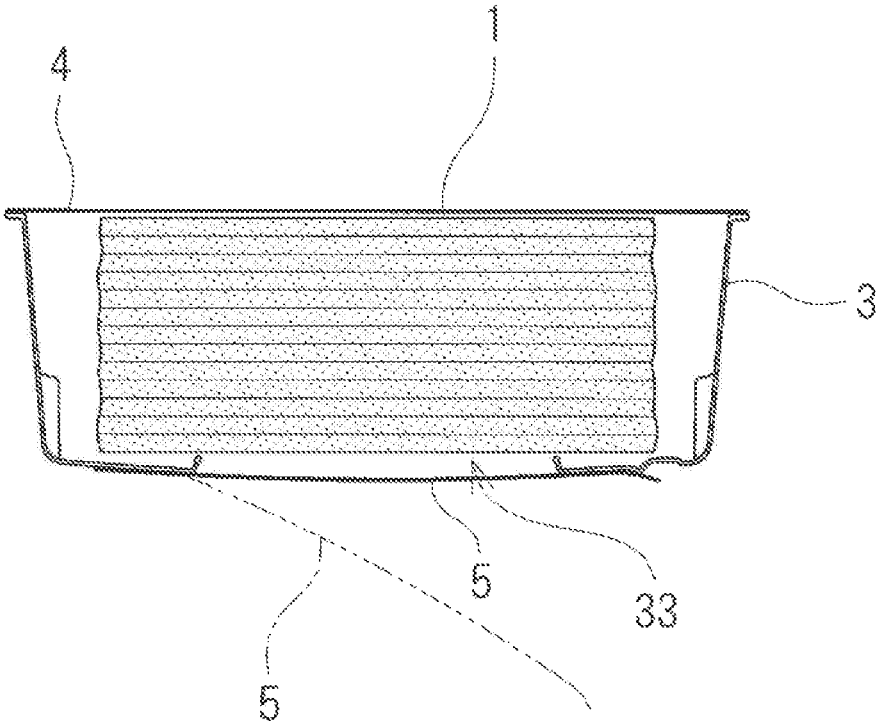

It is noted that in the above embodiment, the wet sheets 1 are layered vertically. In the above embodiment, a direction in which the wet sheets 1 are layered is a vertical direction. However, the direction in which the wet sheets 1 are layered is not limited to the vertical direction. As illustrated in FIGS. 18(*a*) and 18(*b*), the direction in which the wet, sheets 1 are layered may be a horizontal direction. When the wet sheets 1 are housed in the inner bag 2 in a folded state, a fold 1*a* of the wet sheets 1 may face upward, as in FIG. 18(*a*). The fold 1*a* of the wet sheets 1 may face downward, as in FIG. 18(*b*). Although illustration is not provided, the fold 1*a* of the wet sheets 1 may face laterally.

It is noted that an opening/closing lid for opening and closing the dispensing openings 33 and 71 may be an opening/closing lid made of rigid plastic.

REFERENCE SIGNS LIST

1 wet sheet
1*a* fold
2 inner bag
3 case (packaging container)
4 bottom lid (packaging container)
5 flap (opening and closing lid)
10 sheet base material
11 liquid
20 side gusset part
21 bottom part
22 protrusion piece
23 bottom sealed part
24 opening part
25 end
25*a* portion at short side, out of end
25*b* portion at long side, out of end
30 ceiling part
31 side surface part
32 flange part
33 dispensing opening
34 annular projection
35 concave part
36 convex part
37 vertical lib
38 bottom surface opening part
50 pinched part
51 cut line for stopper
60 nozzle
70 packaging bag (packaging body)
71 dispensing opening
72 opening part

The invention claimed is:

1. A wet sheet packaging body comprising:
a plurality of wet sheets;
a packaging container configured to house the plurality of wet sheets, where the packaging container includes a top surface and a dispensing opening on the top surface, configured to take out each of the wet sheets; and
an opening and closing lid configured to open and close the dispensing opening of the packaging container,
the plurality of wet sheets being housed in a layered state in the packaging container, wherein
an inner bag including an opening part and a bottom part is provided,
the plurality of wet sheets are housed in the inner bag,
the inner bag is housed in the packaging container while the opening part is directed downward and the bottom part is directed upward,
the inner bag is pulled out from the dispensing opening of the packaging container for removal when use of the wet sheet packaging body is started,
the packaging container includes a case and a bottom lid,
the case includes a bottom surface opening part,
the bottom lid closes the bottom surface opening part of the case,
the case includes a side surface part,
the side surface part of the case includes a lower end surface,
the bottom lid is configured of a film, and
the bottom lid is heat sealed to the lower end surface of the side surface part of the case.

2. The wet sheet packaging body according to claim 1, wherein the inner bag includes an end at a side of the opening part of the inner bag, and
the end at the side of the opening part of the inner bag is folded toward the bottom side of the wet sheet.

3. The wet sheet packaging body according to claim 2, wherein a center part of a bottom portion of the wet sheet is not covered with the inner bag and is exposed.

4. A wet sheet packaging body comprising:
a plurality of wet sheets;
a packaging container configured to house the plurality of wet sheets, where the packaging container includes a top surface and a dispensing opening on the top surface, configured to take out each of the wet sheets; and
an opening and closing lid configured to open and close the dispensing opening of the packaging container,
the plurality of wet sheets being housed in a layered state in the packaging container, wherein
an inner bag including an opening part and a bottom part is provided, the plurality of wet sheets are housed in the inner bag, the inner bag is housed in the packaging container while the opening part is directed downward and the bottom part is directed upward, the inner bag is pulled out from the dispensing opening of the packaging container for removal when use of the wet sheet packaging body is started, the packaging container includes a case and a bottom lid, the case includes a bottom surface opening part, the bottom lid closes the bottom surface opening part of the case, the case includes, at an opening edge of the dispensing opening, an annular projection projecting downward.

5. The wet sheet packaging body according to claim 4, wherein the inner bag includes an end at a side of the opening part of the inner bag, and the end at the side of the opening part of the inner bag is folded toward the bottom side of the wet sheet.

6. The wet sheet packaging body according to claim 5, wherein a center part of a bottom portion of the wet sheet is not covered with the inner bag and is exposed.

7. A wet sheet packaging body comprising:

a plurality of wet sheets;

a packaging container configured to house the plurality of wet sheets, where the packaging container includes a top surface and a dispensing opening, on the top surface, configured to take out each of the wet sheets; and an opening and closing lid configured to open and close the dispensing opening of the packaging container, the plurality of wet sheets being housed in a layered state in the packaging container, wherein an inner bag including an opening part and a bottom part is provided, the plurality of wet sheets are housed in the inner bag, the inner bag is housed in the packaging container while the opening part is directed downward and the bottom part is directed upward, and the inner bag is pulled out from the dispensing opening of the packaging container for removal when use of the wet sheet packaging body is started, and the inner bag is a lateral gusset bag.

8. The wet sheet packaging body according to claim 7, wherein the inner bag includes an end at a side of the opening part of the inner bag, and the end at the side of the opening part of the inner bag is folded toward the bottom side of the wet sheet.

9. The wet sheet packaging body according to claim 8, wherein a center part of a bottom portion of the wet sheet is not covered with the inner bag and is exposed.

10. A wet sheet packaging body comprising:

a plurality of wet sheets;

a packaging container configured to house the plurality of wet sheets, where the packaging container includes a top surface and a dispensing opening, on the top surface, configured to take out each of the wet sheets; and an opening and closing lid configured to open and close the dispensing opening of the packaging container, the plurality of wet sheets being housed in a layered state in the packaging container, wherein an inner bag including an opening part and a bottom part is provided, the plurality of wet sheets are housed in the inner bag, the inner bag is housed in the packaging container while the opening part is directed downward and the bottom part is directed upward, the inner bag is pulled out from the dispensing opening of the packaging container for removal when use of the wet sheet packaging body is started, the inner bag includes inner surfaces, the inner bag includes, at the bottom part, a protrusion piece with the inner surfaces of the inner bag overlapping with each other, and the inner bag can be pulled out from the dispensing opening of the packaging container by pinching the protrusion piece when use of the wet sheet packaging body is started.

11. The wet sheet packaging body according to claim 10, wherein the inner bag includes an end at a side of the opening part of the inner bag, and the end at the side of the opening part of the inner bag is folded toward the bottom side of the wet sheet.

12. The wet sheet packaging body according to claim 11, wherein a center part of a bottom portion of the wet sheet is not covered with the inner bag and is exposed.

* * * * *